US008807671B2

(12) United States Patent
Brunnmayr

(10) Patent No.: US 8,807,671 B2
(45) Date of Patent: Aug. 19, 2014

(54) LOCKABLE EJECTION DEVICE WITH OVERLOAD MECHANISM

(71) Applicant: Julius Blum GmbH, Hochst (AT)
(72) Inventor: Harald Brunnmayr, Horbranz (AT)
(73) Assignee: Julius Blum GmbH, Hochst (AT)

( * ) Notice: Subject to any disclaimer, the term of this patent is extended or adjusted under 35 U.S.C. 154(b) by 0 days.
(21) Appl. No.: 14/039,335
(22) Filed: Sep. 27, 2013
(65) Prior Publication Data
US 2014/0021841 A1 Jan. 23, 2014

Related U.S. Application Data
(63) Continuation of application No. PCT/AT2012/000114, filed on Apr. 26, 2012.
(30) Foreign Application Priority Data
May 3, 2011 (AT) ..... A 614/2011
(51) Int. Cl.
*A47B 88/04* (2006.01)
*A47B 88/16* (2006.01)
(52) U.S. Cl.
CPC ..... *A47B 88/0477* (2013.01); *A47B 88/16* (2013.01)
USPC ..... 312/333; 312/319.1
(58) Field of Classification Search
USPC ..... 312/330.1, 333, 334.1, 334.7, 334.8, 312/334.44, 319.1
See application file for complete search history.

(56) References Cited

U.S. PATENT DOCUMENTS

2007/0090735 A1 4/2007 Hashemi et al.
2009/0072687 A1 3/2009 Fitz
2009/0273263 A1* 11/2009 Berger ..... 312/334.1

FOREIGN PATENT DOCUMENTS

| | | |
|---|---|---|
| DE | 20 2009 004 955 | 12/2010 |
| DE | 20 2009 005 256 | 12/2010 |
| EP | 2 266 436 | 12/2010 |
| EP | 2 272 400 | 1/2011 |
| JP | 2003-223643 | 8/2003 |
| JP | 2007-9507 | 1/2007 |
| JP | 4064677 | 1/2008 |
| WO | 2007/050737 | 5/2007 |
| WO | 2007/112463 | 10/2007 |

OTHER PUBLICATIONS

International Search Report (ISR) issued Oct. 9, 2012 in International (PCT) Application No. PCT/AT2012/000114.
Austrian Patent Office Search Report (ASR) issued Dec. 6, 2011 in Austrian Patent Application No. A 614/2011.

* cited by examiner

*Primary Examiner* — James O Hansen
(74) *Attorney, Agent, or Firm* — Wenderoth, Lind & Ponack, L.L.P.

(57) ABSTRACT

A lockable ejection device for a movable furniture part has a control pin movable in a cardioid-shaped slotted guide track. The slotted guide track includes a closing section, in which the control pin moves as the movable furniture part is closed, a locking section having a latching depression in which the control pin is held in the locked position, and an opening section in which the control pin is movable as the mobile furniture part is opened. An overload mechanism is arranged in the locking section. The overload mechanism includes a blocking element to which force is applied and which temporarily blocks an overload path for the control pin. The blocking element at least partially co-forms the latching depression of the locking section and the overload path that can be blocked by the blocking element leads through a channel defined by a channel wall.

21 Claims, 24 Drawing Sheets

LOCKABLE EJECTION DEVICE WITH OVERLOAD MECHANISM

BACKGROUND OF THE INVENTION

The invention concerns a lockable ejection device for a moveable furniture part, comprising a control pin moveable in a cardioid-shaped sliding guide track. The sliding guide track has a closing portion in which the control pin moves upon closure of the moveable furniture part. A locking portion has a latching depression in which the control pin is held in the locking position, and an opening portion in which the control pin is moveable upon opening of the moveable furniture part. Arranged in the locking portion is an overload mechanism by which the locking position is releasable even upon movement of the moveable furniture part in the opening direction, and the overload mechanism has a blocking element which is subjected to a force and which temporarily blocks an overload path for the control pin.

Lockable ejection devices (also referred to as touch-latch mechanisms) are used in particular in relation to drawers and serve to provide that, when pressure is applied to the closed drawer, the drawer is unlocked and automatic ejection or opening of the drawer takes place. In the first designs of such lockable ejection devices, ejection could be effected only by pressing against the drawer (overpressing in the closing direction). If, however, when the drawer was closed it was not pressed but rather was pulled in the opening direction, individual components could be overloaded or even destroyed.

To avoid that problem, overload mechanisms were fitted in such lockable ejection devices. An example of such an overload mechanism is to be found in DE 20 2009 005 256 U1. In that case, the region in which the control pin is disposed in the locking position is rotated for example upon movement of the drawer in the opening direction, or an overload path is opened in the region of the "heart" of the cardioid-like sliding guide track. A variant also provides that the sliding guide track itself is formed from two parts and they are displaced relative to each other in an overload situation. In all embodiments according to the above-indicated specification, there must be a change in the normal, cardioid-shaped path for the control pin. As a result, regions of the actual sliding guide track are always blocked. Particularly when, after such an overload, the moving part no longer moves back into the normal position in good time, the normal cardioid-like path can no longer have the control pin passing entirely therethrough. That can result in defective triggering processes. It is, however, also possible for the closed position or the locking position to be no longer correctly attained.

In a similar fashion JP 2007-009507, in particular in FIG. 7 thereof, shows an overload mechanism in which a part of the "heart" of the cardioid-like sliding guide track can be pivoted in an overload situation and thereby opens a path for the control pin in the opening direction. This arrangement also suffers from the disadvantage that the normal path of the control pin is displaced by that pivotal movement. If that path is not cleared again in good time, the problems already referred to above can arise.

WO 2007/050737 A2 discloses a cardioid-shaped locking portion having a latching depression in which a control pin latchingly engages. A relatively narrow overload passage is already provided in the cardioid configuration, in the region of that latching depression. As the cardioid shape-forming parts comprise a flexible material, the control pin can be forced through those flexible parts, when an overload occurs. A disadvantage in that respect is that the flexible materials can wear away due to the control pin being forced therethrough, in multiple overload movements, whereby an unwanted increase in width of the passage can occur. That can result in an unwanted locking effect even with a normal load being involved or with a slight overload.

SUMMARY OF THE INVENTION

Therefore, the object of the present invention is to provide a lockable ejection device which is improved over the state of the art. In particular, the overload mechanism has such a design configuration that the normal path in the sliding guide track remains as unaffected as possible.

For an ejection device having the features of the classifying portion of the present invention, that object is attained in that the blocking element at least partially also forms the latching depression of the locking portion and the overload path which is blockable by the blocking element leads through a passage which can be passed through by the control pin upon an overload and which is defined by a passage wall and which is in a fixed spatial relationship with the closing portion and the opening portion and which opens into the opening portion. The blocking element is provided separately from the passage wall and is moveable in the passage. In other words, this means that, in the event of an overload, only the blocking element is moveable in the locking portion of the sliding guide track by the control pin as it moves in the opening direction. The other regions (closing portion, opening portion, and at least in part the locking portion) remain unchanged. In addition, the locking position can be released in damage-free fashion by the blocking element. A further advantage with the invention is that it is not the frictional forces that provide for the overload safeguard, as when spreading or forcing open the "heart" (see the state of the art), but rather it is a well-defined, precisely associated force actuation in respect of the blocking element that permits an exact pulling triggering effect.

To permit a defined triggering path upon movement of the moveable furniture part in the opening direction, the blocking element in the locking position cab block a first part of the overload path, wherein in an overload situation the blocking element is moveable by the control pin in the opening direction against the force actuation of the blocking element out of the position of blocking the overload path and the first part of the overload path is cleared. The distance which has to be exceeded in the opening direction to permit ejection of the ejection device is also dependent on the length (for example between 2 and 5 mm) of the first part of the overload path. Accordingly, when the first part of the overload path is cleared, the control pin is moveable into a second part of the overload path, in which the ejection device is unlocked and the moveable furniture part can be ejected in the opening direction by an ejection spring of the ejection device. It can further preferably be provided for that purpose that the blocking element is subjected to a force by a spring, wherein the spring is in the form of a compression spring.

As the control pin in the locking position is in a force-operative connected relationship both with the ejection spring and also with the blocking element spring, the spring force of the spring of the blocking element is greater than the spring force of the ejection spring. That guarantees that the blocking element is not released by the ejection spring itself, but only in the case of an additional force applied by the user by pulling out the moveable furniture part.

In a preferred embodiment of the invention, the control pin in the locking position bears only against the blocking element, that is to say a large part or the entire latching depression is formed by the blocking element itself.

Basically, the ejection device can be of any desired configuration and can be arranged in any desired way, as are shown for example in DE 20 2009 005 256 U1 and JP 2007-009507. The only essential consideration is that there is an overload mechanism according to the invention. Nonetheless a preferred embodiment includes a housing in which the sliding guide track is provided, a slider displaceable along the housing, wherein the ejection spring is connected with one end to the slider and with the other end to the housing. A control lever is mounted pivotably to the slider, on which the control pin engaging into the sliding guide track is arranged, and an ejection element for the moveable furniture part is arranged on the slider and which is preferably pivotably mounted.

In order to achieve adjustment of the locking position in the case of such an ejection device, the housing can have a portion which is displaceable by a depth adjusting device and in which the sliding guide track is provided.

An article of furniture can include a furniture carcass, a moveable furniture part, in particular a drawer, and a lockable ejection device described above.

In the case of such an article of furniture, it is possible for the ejection device to be associated with the furniture carcass and to act on an entrainment member associated with the moveable furniture part. In an embodiment of the present invention, however, it is conversely provided that the moveable furniture part is mounted displaceably to the furniture carcass by a drawer rail which is or can be connected to the furniture part, optionally a central rail, and a carcass rail connected to the furniture carcass. The ejection device is arranged at the drawer rail or at the moveable furniture part, and the ejection element at least in the closed position of the moveable furniture part is connected preferably in positively locking relationship to an entrainment member arranged on the furniture carcass or on the carcass rail respectively.

An essential notion of the invention also provides that ejection of the moveable furniture part is effected not only by overpressing the drawer but also by pulling on the drawer. For that purpose, either by overpressing the moveable furniture part from the closed position into a position behind the closed position, or by pulling the moveable furniture part out of the closed position in the opening direction, the control pin passes out of the locking portion into the opening portion or into the second part of the overload path and the ejection device is unlocked. The ejection spring which can be unloaded when the ejection device is unlocked provides that the housing connected to the moveable furniture part is moveable relative to the slider held on the entrainment member that is fixed with respect to the carcass, and the moveable furniture part can be ejected in the opening direction.

BRIEF DESCRIPTION OF THE DRAWINGS

Further details and advantages of the present invention are described more fully hereinafter by the specific description with reference to the embodiments by way of example illustrated in the drawings, in which.

DETAILED DESCRIPTION OF THE INVENTION

Figure 1:
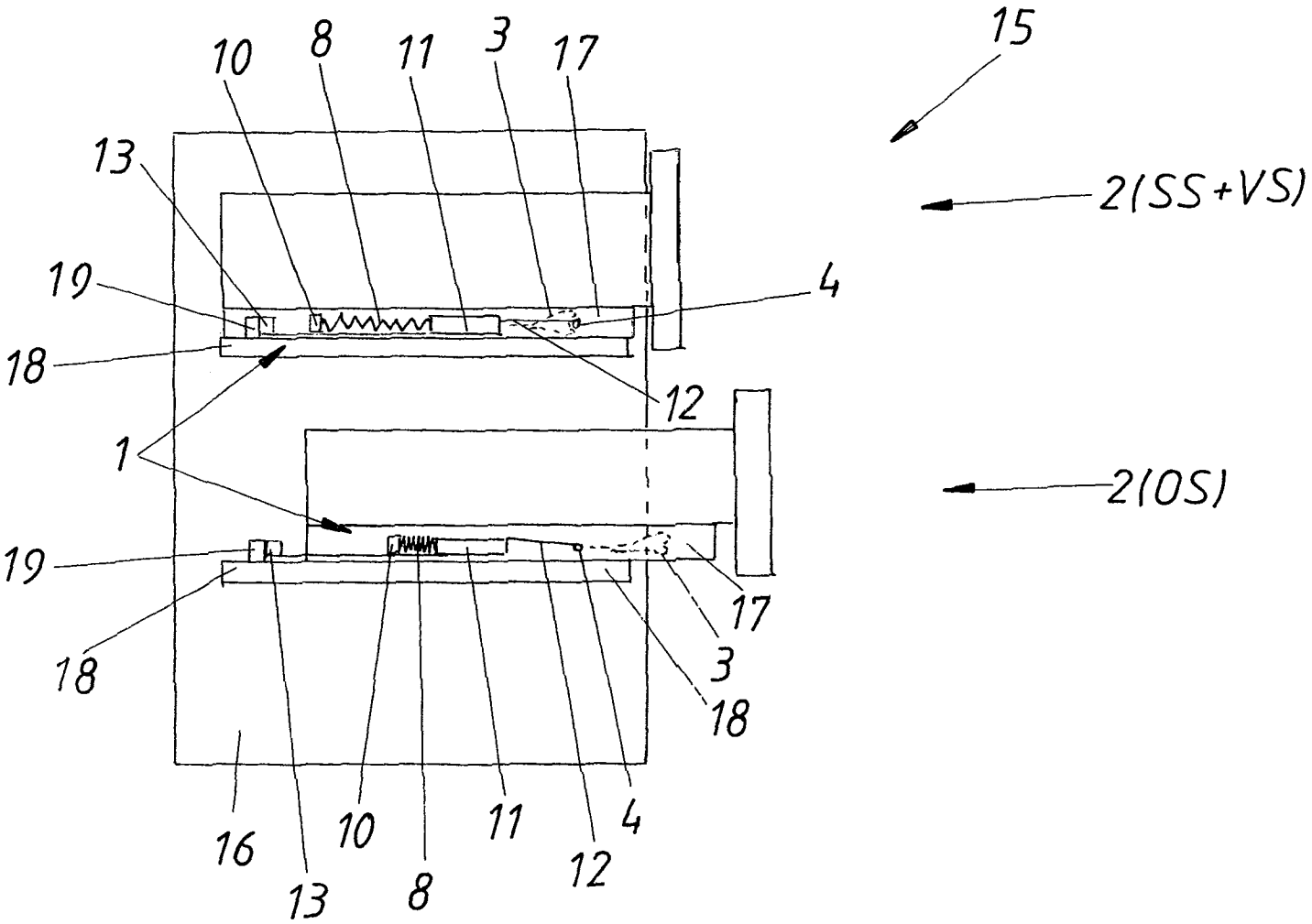
FIG. 1 diagrammatically shows an article of furniture with closed and opened drawers.

FIG. 1 shows an article of furniture 15 including a furniture carcass 16 and two moveable furniture parts 2. In this case, the upper moveable furniture part 2 is in a closed position SS, wherein the control pin 4 is held in the sliding guide track 3 in the locking position VS. That control pin 4 is connected by a control lever 12 to a slider 11 displaceable in the housing 10 (only diagrammatically indicated here). The slider 11 is connected to the housing 10 by an ejection spring 8, the ejection spring 8 (tension spring) being stressed in that locking position VS. The ejection device 1 is mounted to the drawer rail 17, and the drawer rail 17 is locked relative to the carcass rail 18 and is therefore not displaceable as the drawer rail 17 is held to the entrainment member 19 of the carcass rail 18 by the ejection device 1 and its ejection element 13 (with locking hook).

If now—as shown in relation to the lower moveable furniture part 2 in FIG. 1—triggering is effected (that is possible both by overpressing the moveable furniture part 2 and also by pulling thereon) then the control pin 4 passes outside the locking portion 3*b* of the sliding guide track 3. As the slider 11 is then no longer locked in the sliding guide track 3, the ejection spring 8 can contract, whereby the housing 10 of the ejection device 1 is moved together with the moveable furniture part 2 mounted thereto, in the opening direction OR. As the slider itself 11 is still connected in positively locking relationship to the entrainment member 19 by the ejection element 13, displacement of the housing 10 occurs relative to the slider 11 and the moveable furniture part 2 passes into the open position OS.

Figure 2:
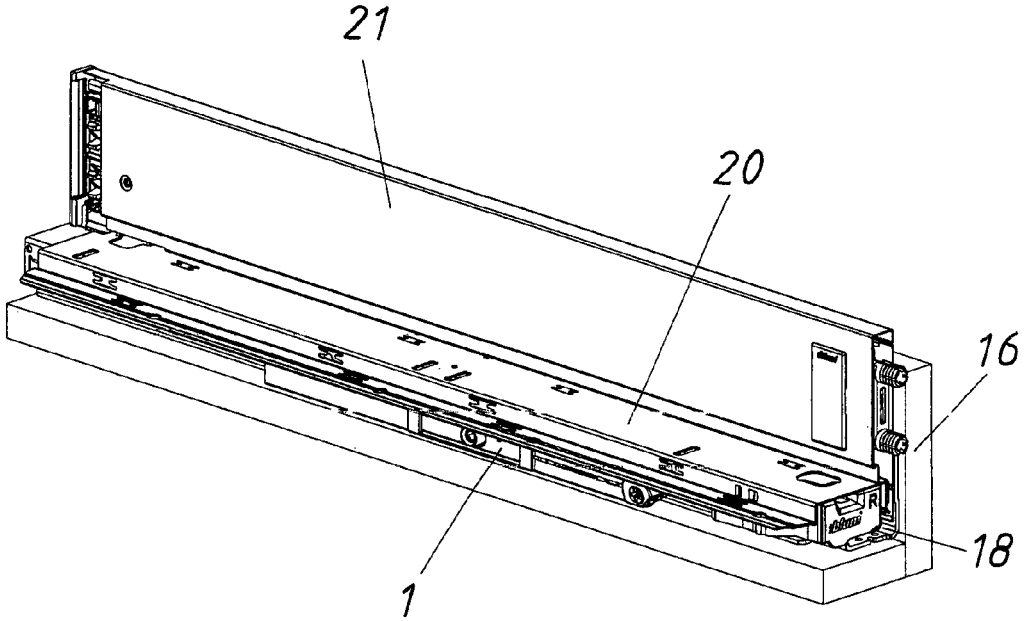
FIG. 2 shows a view of a drawer extension guide with drawer side wall and furniture carcass.

FIG. 2 shows a side wall of the moveable furniture part 2 and the container rail 20 held to the drawer rail 17 (this is poorly visible here). The ejection device 1 is fixed under the drawer rail 17 or under the container rail 20.

Figure 3:
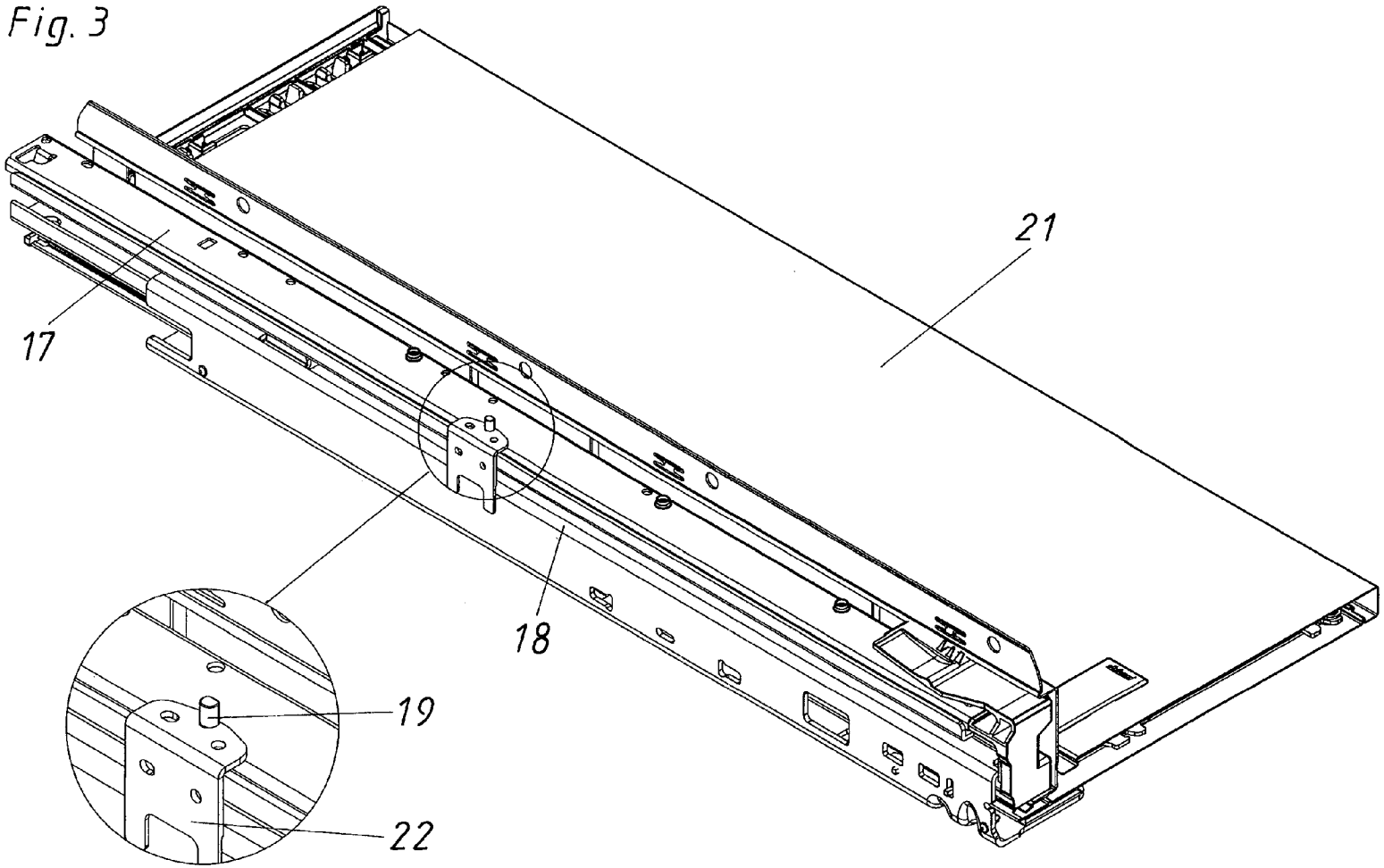
FIG. 3 shows a part of the drawer side wall with an extension guide.

FIG. 3 shows the drawer side wall 21. The entrainment member 19 is fixed to the carcass rail 18 by a mounting element 22.

Figure 4:
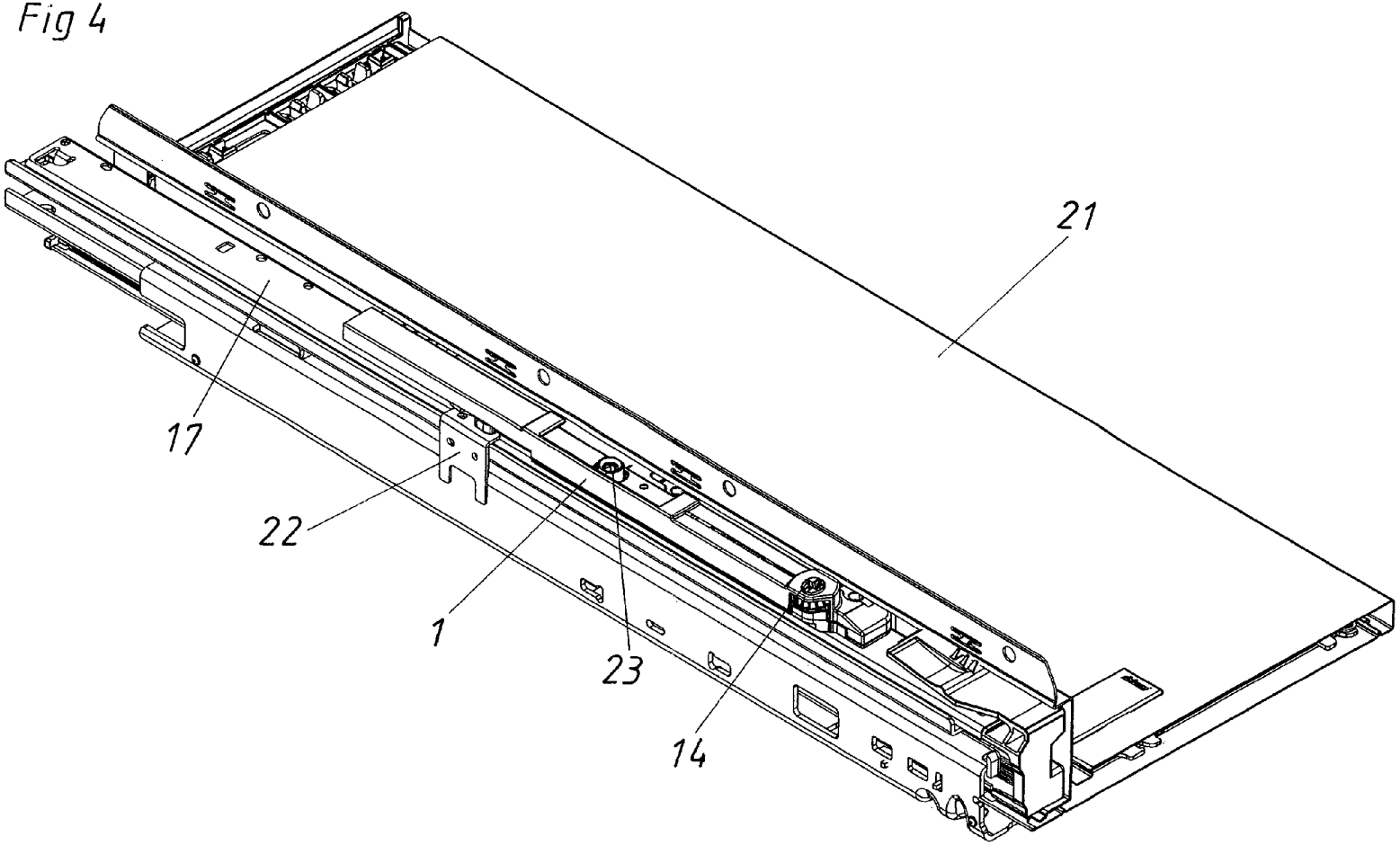
FIG. 4 shows FIG. 3 with an ejection device fitted.

FIG. 4 shows the drawer side wall 21 together with the ejection device 1 mounted to the drawer rail 17. In this case, the connecting element 23 for synchronization with a second ejection device associated with another drawer side wall (not shown) and a depth adjusting device 14 can be seen.

Figure 5:
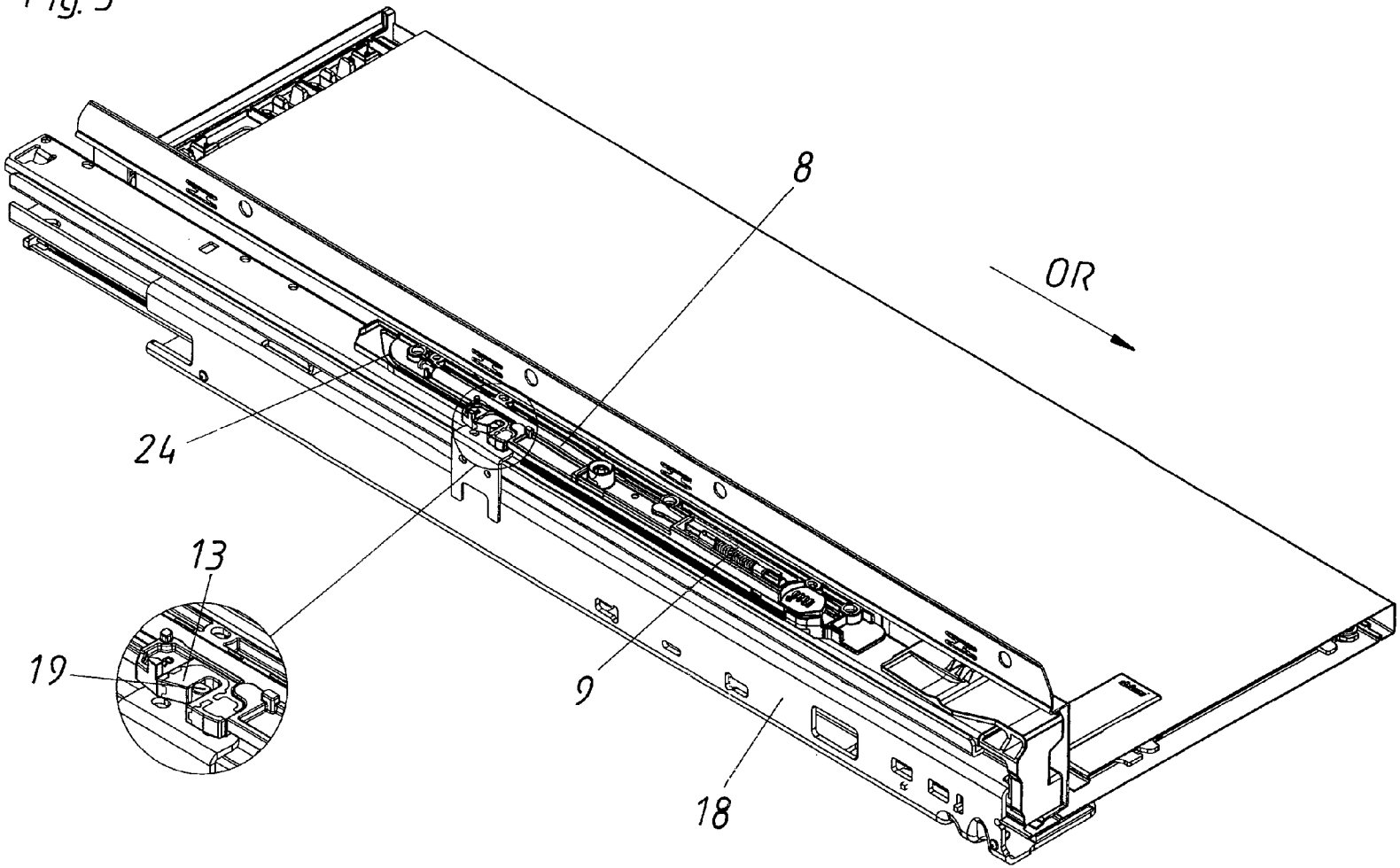
FIGS. 5 through 7 show different positions of the moveable furniture part relative to the furniture carcass rail.

In FIG. 5 the housing cover 10*c* is removed from the ejection device 1, thereby providing a view into the ejection device 1. It will be seen therein that the ejection element 13 (locking hook) is connected to the entrainment member 19 in positively locking relationship. That ejection element 13 moves in the guide track 24. The ejection spring 8 and the spring 9 for the blocking element 7 are also shown.

Figure 6:
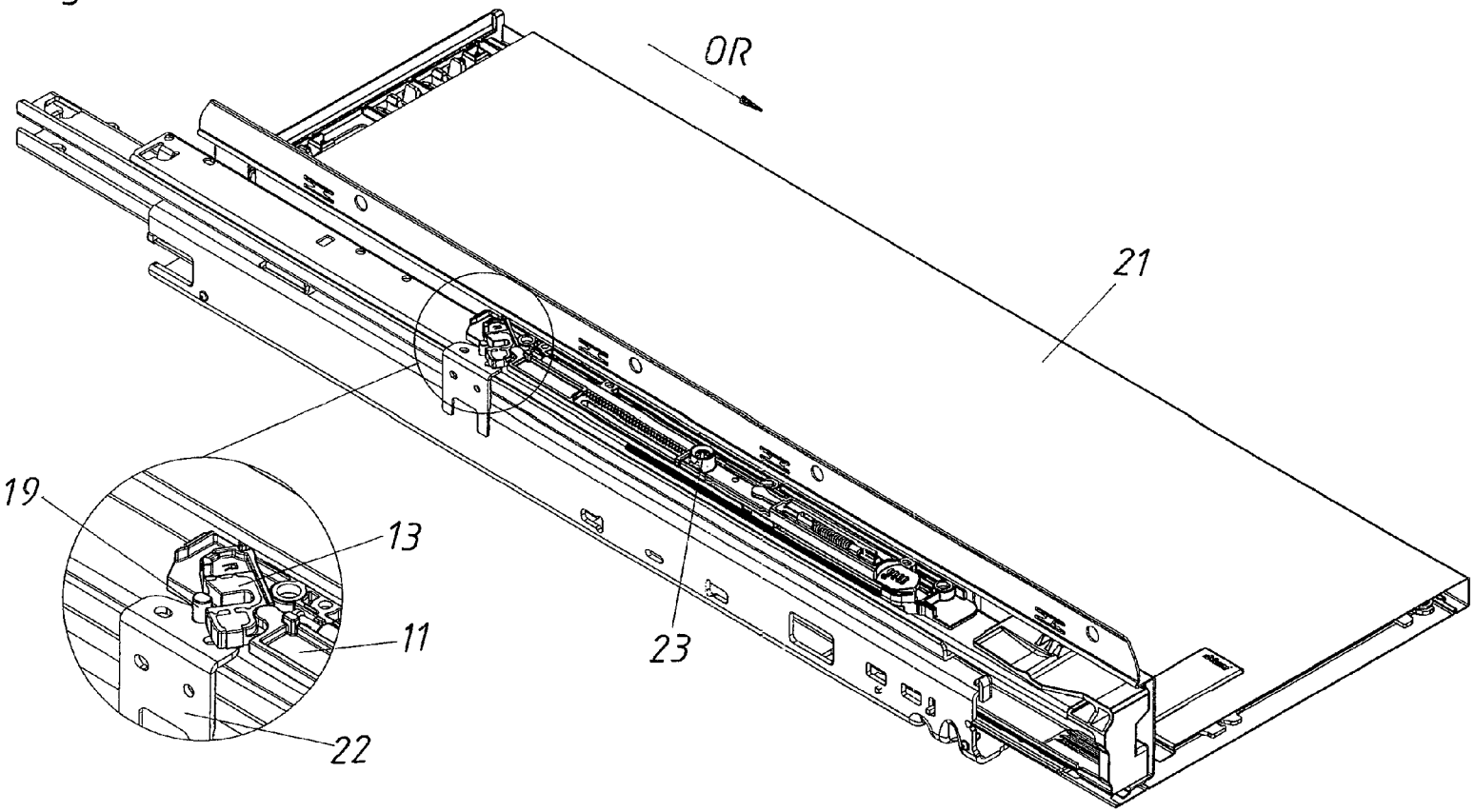
Figure 7:
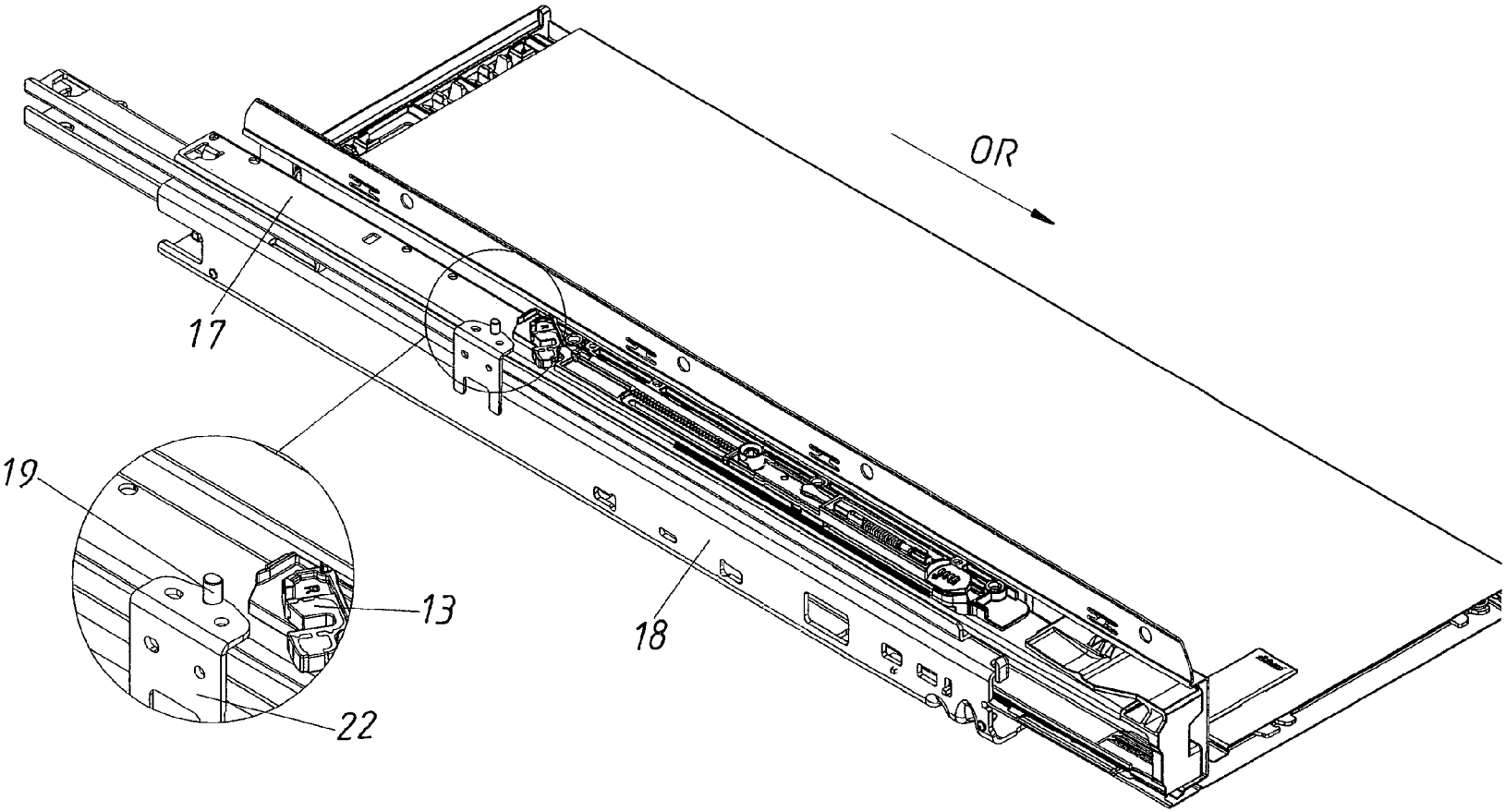

In FIG. 6 the moveable furniture part 2 together with the drawer side wall 21 is moved further in the opening direction OR, in which case the ejection element 13 has passed into the inclined end region of the guide path 24 and is thereby pivoted relative to the slider 11 and releases the entrainment member 19. From that moment in time or from that position, the moveable furniture part 2 can be moved freely in the opening direction OR (see also FIG. 7).

Figure 8:
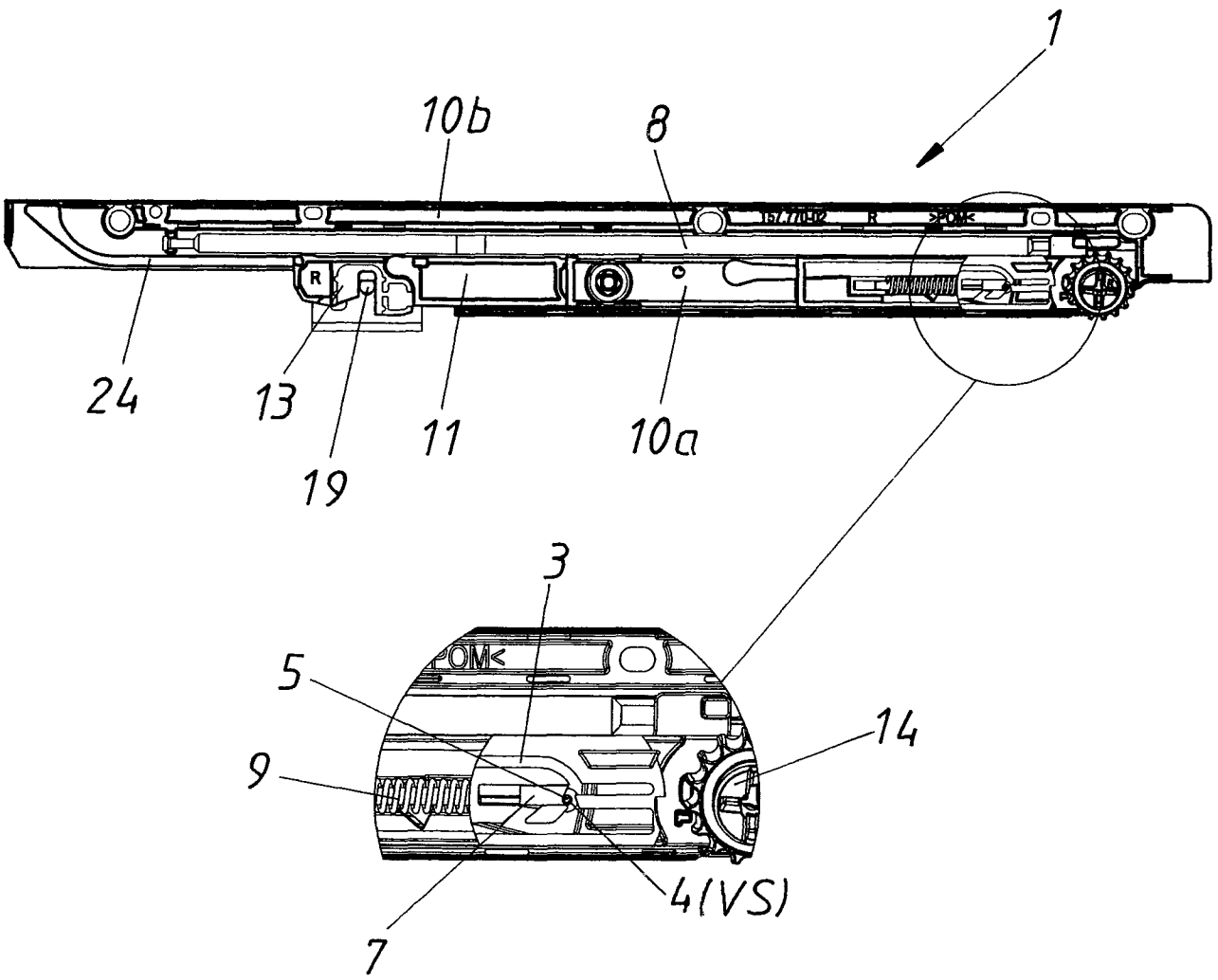
FIGS. 8 through 12 show a side view of the ejection device in different positions.

FIG. 8 shows a view of the ejection device 1 from the center of the furniture part. In this case, the housing cover 10*c* is entirely removed. In addition, a part of the displaceable portion 10*a* is also cut out, thereby giving a view of the sliding guide track 3 in the displaceable portion 10*a*. In FIG. 8, the control pin 4 is in the locking position VS and is disposed in the latching depression 5 on the blocking element 7.

Figure 9:
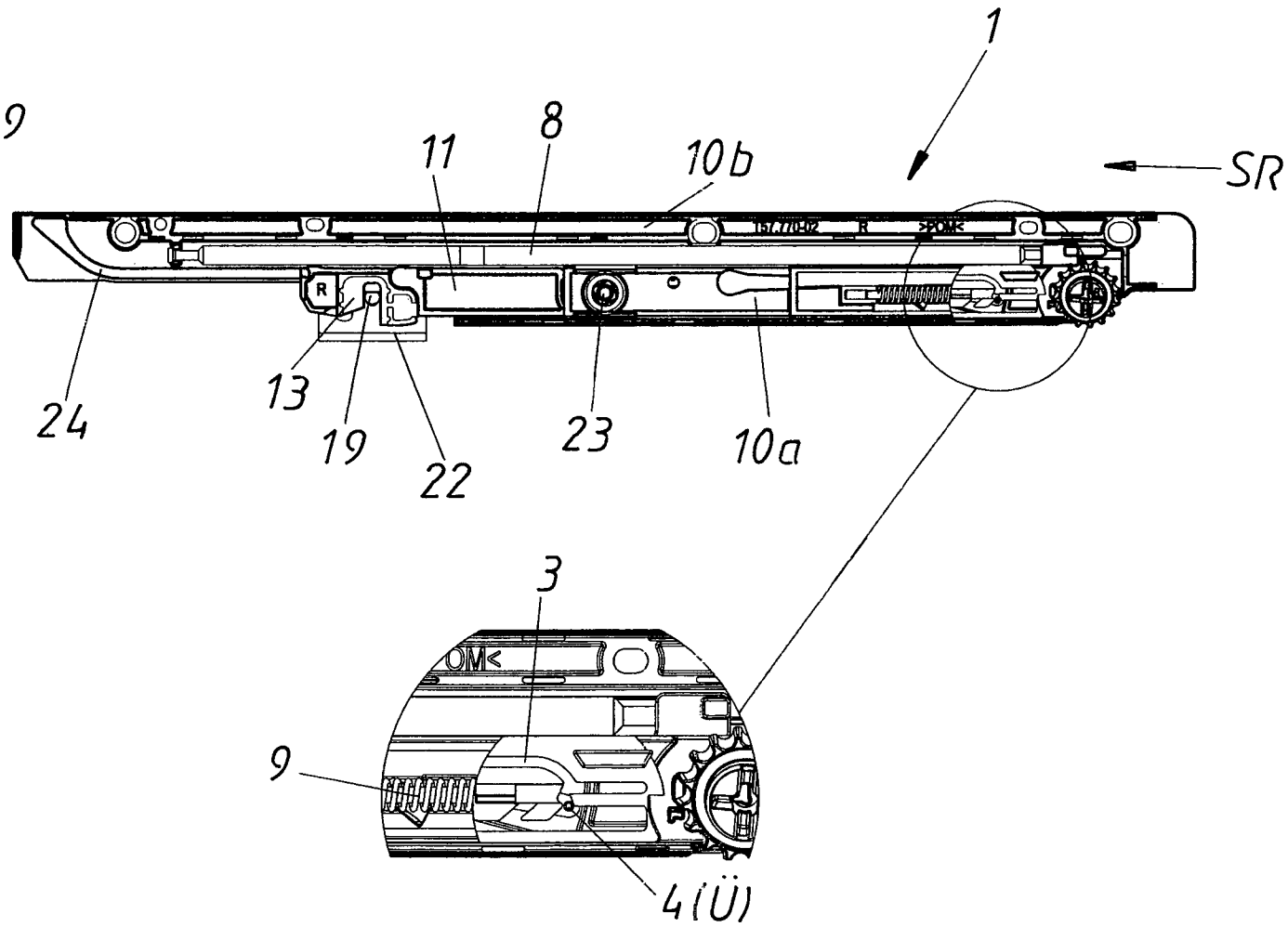
Figure 18:
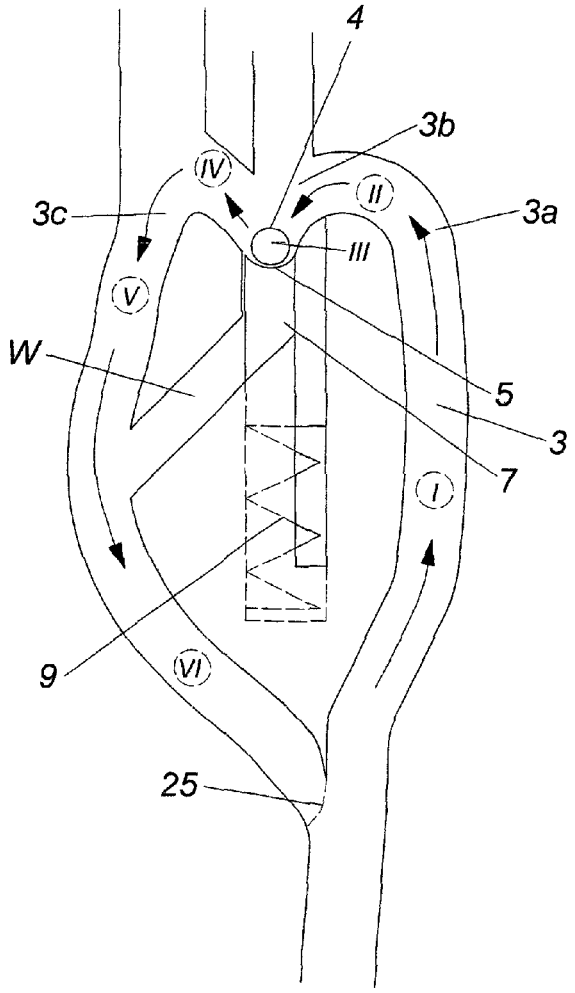
FIG. 18*a* shows the force variation in respect of the springs corresponding to FIG. 18, FIG. 19 diagrammatically shows the configuration of the control pin in the sliding guide track in an overload situation.

In FIG. 9, the control pin 4 is shown in the overpressed position Ü and goes from the locking portion 3*b* into the opening portion 3*c* (see also FIG. 18).

Figure 10:
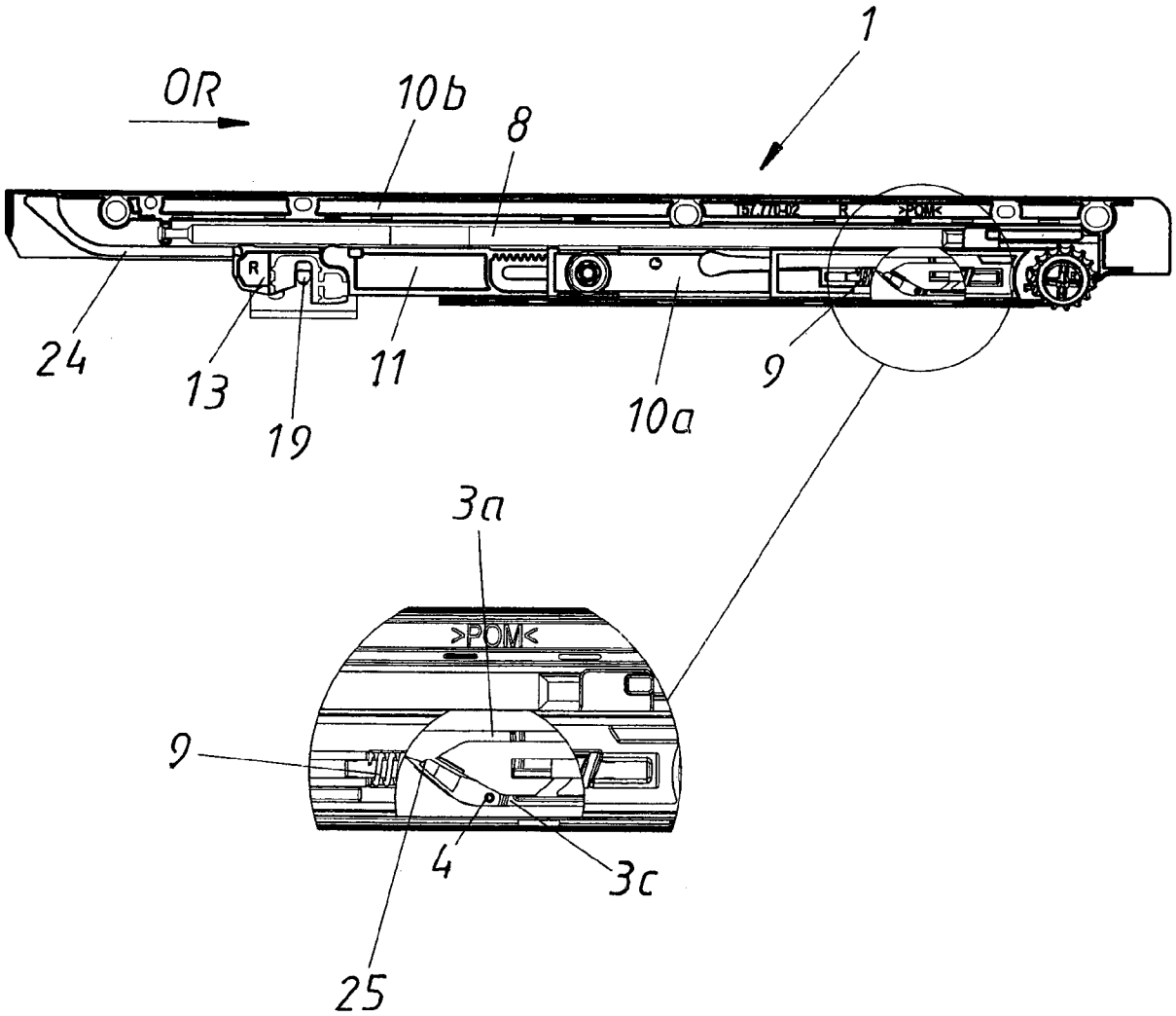

In FIG. 10, the action of the ejection spring 8 is already started whereby the mounting portion 10*b* of the housing 10 moves with respect to the slider 11 in the opening direction OR as the slider 11 itself is held by the ejection element 13 (with locking hook) to the entrainment member 19 and thus to the furniture carcass 16. The control pin 4 is shown shortly before passing over the branching element 25, the control pin 4 pressing that spring-loaded branching element 25 downwardly which moves back into the starting position again after it has passed thereover. Upon movement of the control pin 4 subsequently in the closing direction SR, that permits the control pin 4 to pass or be deflected not into the opening portion 3*c* but into the closing portion 3*a*.

Figure 11:
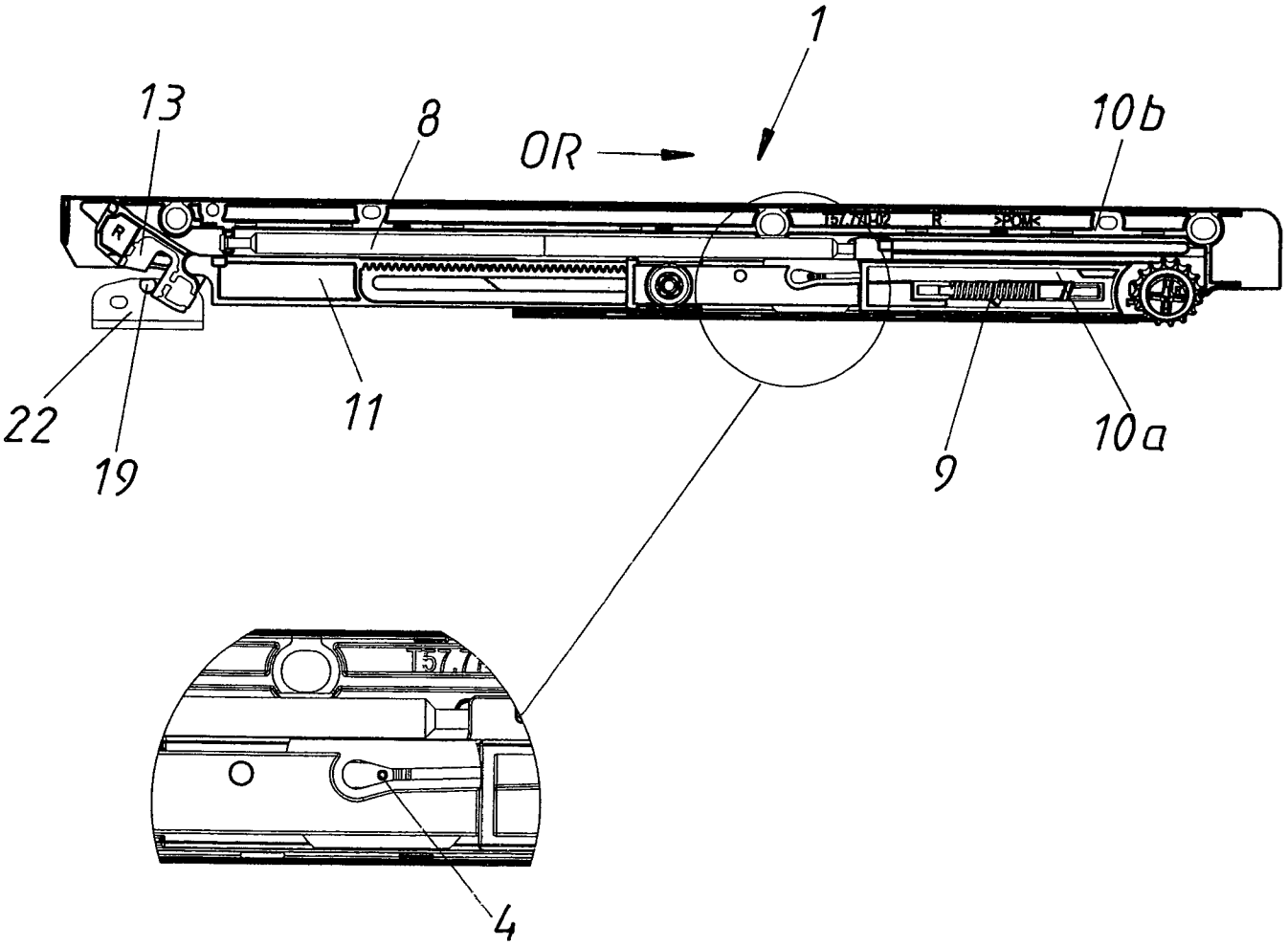

In FIG. 11 the ejection spring 8 is completely unloaded (that is to say contracted) and the slider 11 has moved the ejection element 13 into the inclined end portion of the guide track 24 so that the ejection element 13 is pivoted and the positively locking connection between the ejection element 13 and the entrainment member 19 is released.

Figure 12:
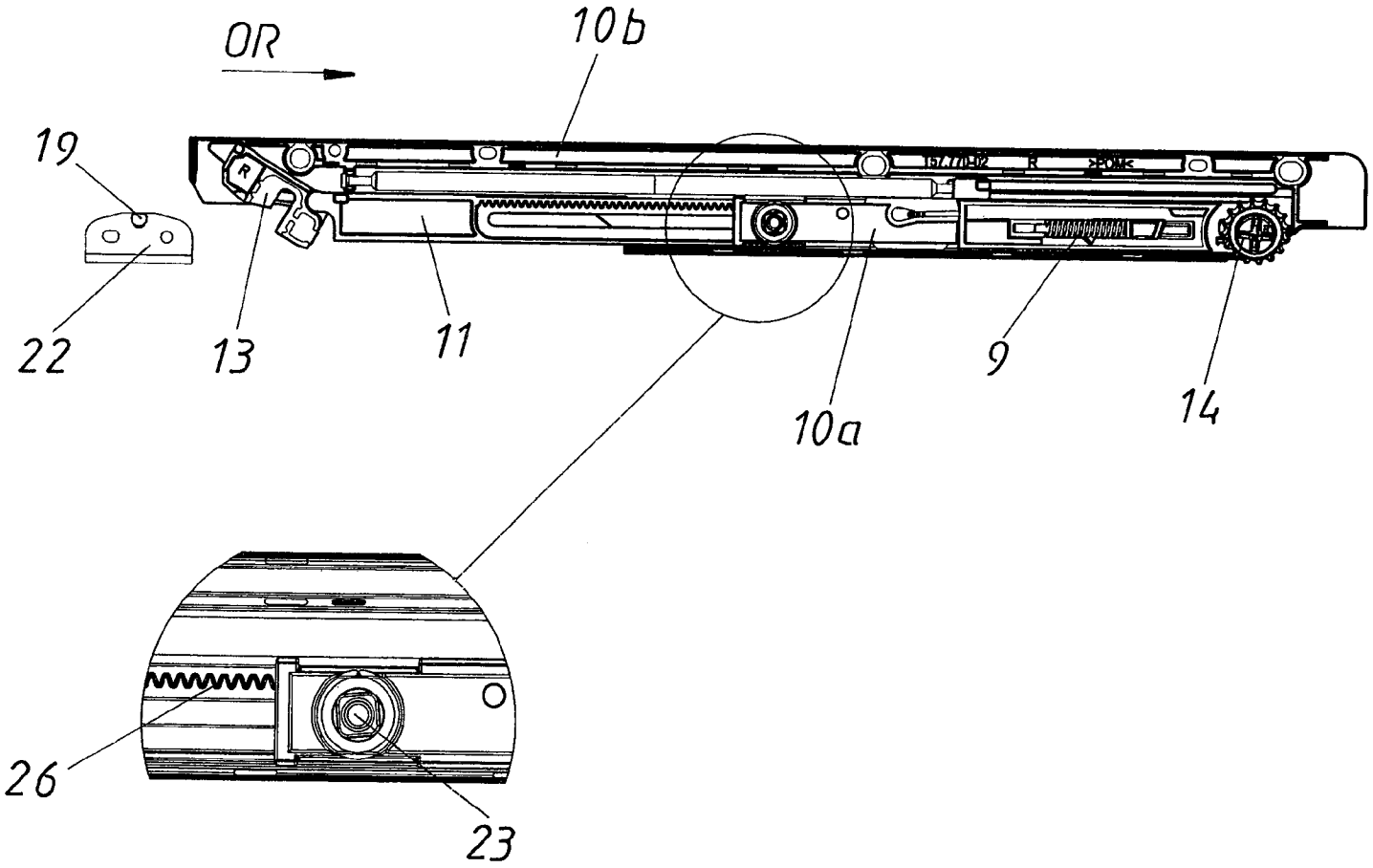

In FIG. 12 the ejection device 1 is no longer held to the entrainment member 19 whereby the entire moveable furniture part 2 is freely moveable.

Figure 13:
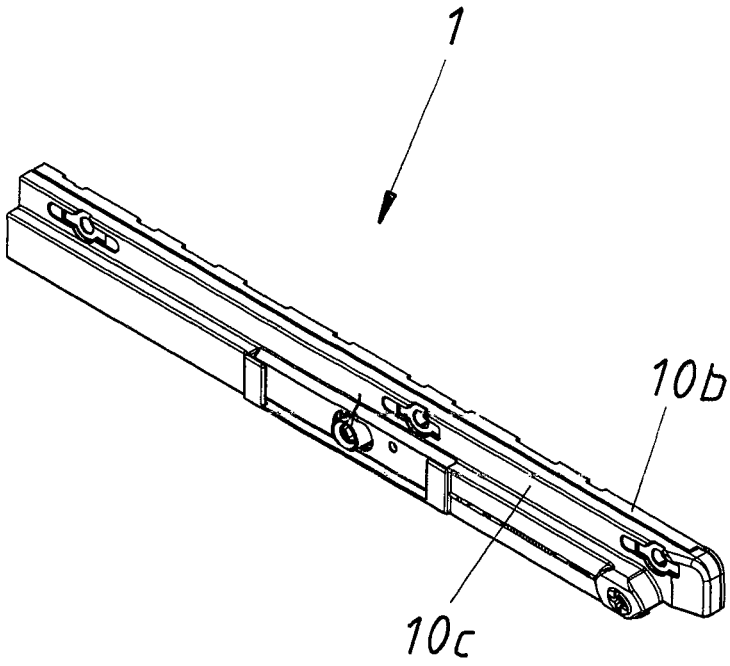
FIG. 13 shows the ejection device in the form of a structural unit.

FIG. 13 shows the narrow elongate ejection device 1 in the assembled condition.

Figure 14:
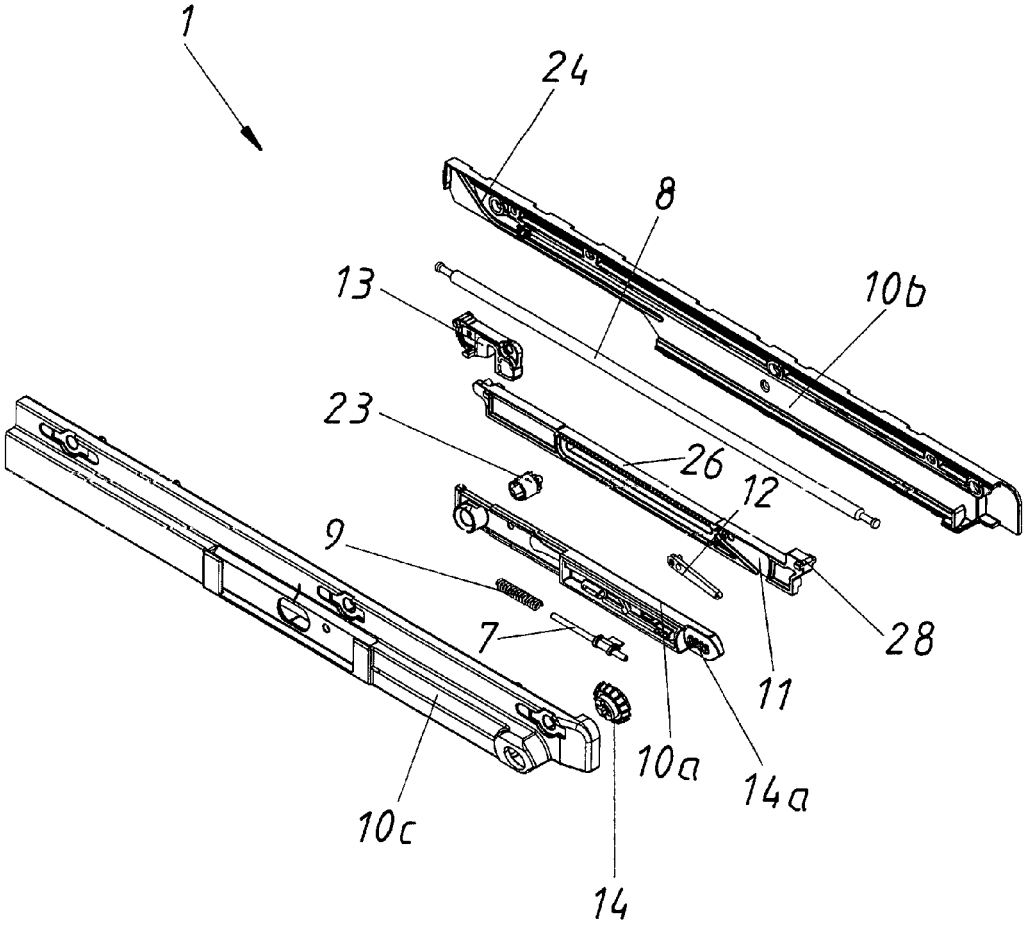
FIGS. 14 and 15 show exploded views of the ejection device from two different sides.
Figure 15:
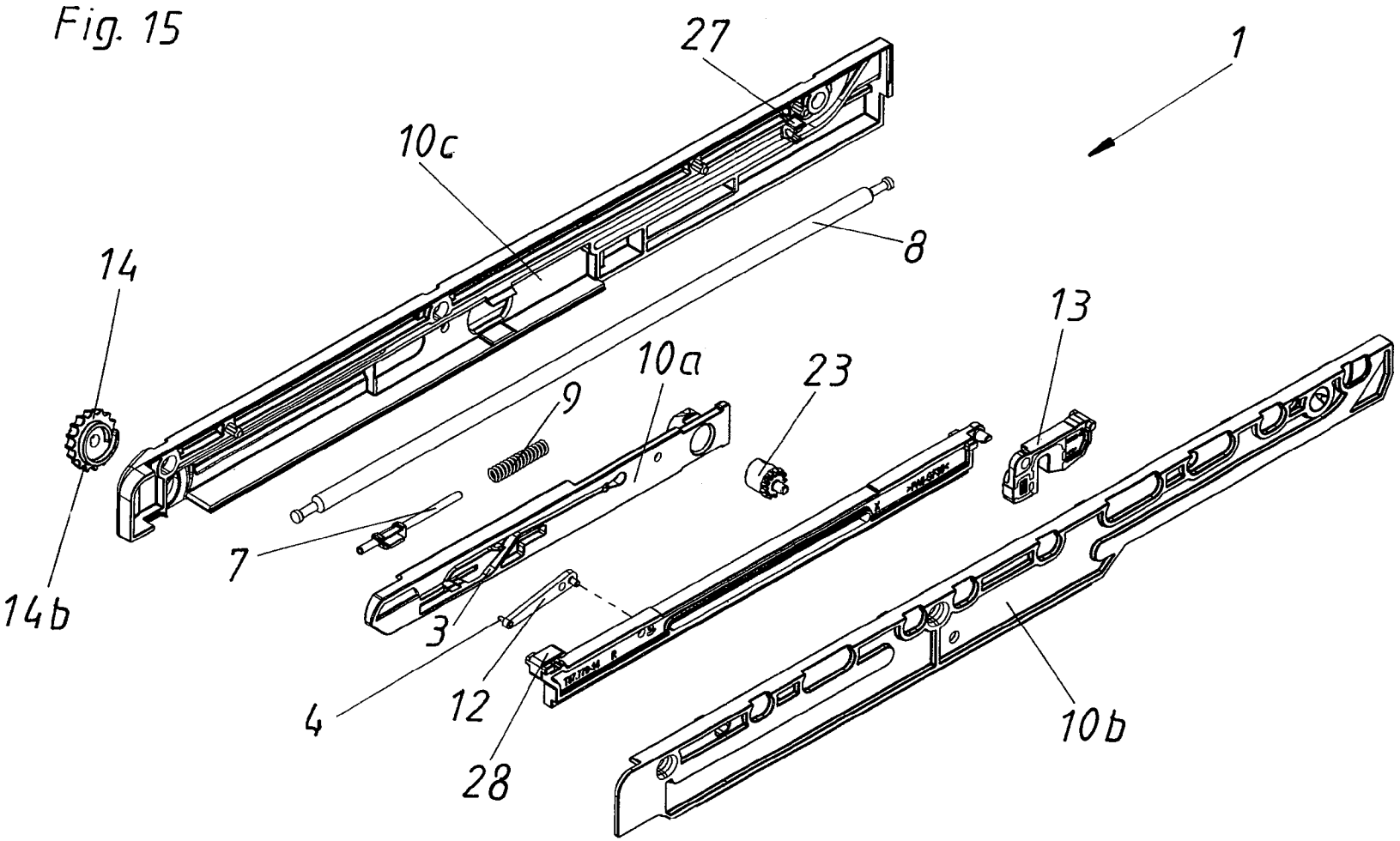
Figure 16:
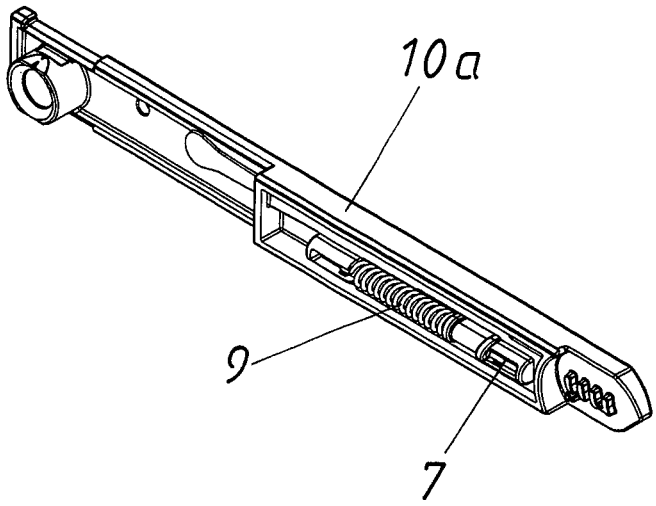
FIGS. 16 and 17 show 3D views of the displaceable portion of the housing with blocking element, FIG. 18 diagrammatically shows the different positions of the control pin in the sliding guide track upon overpressing.
Figure 17:
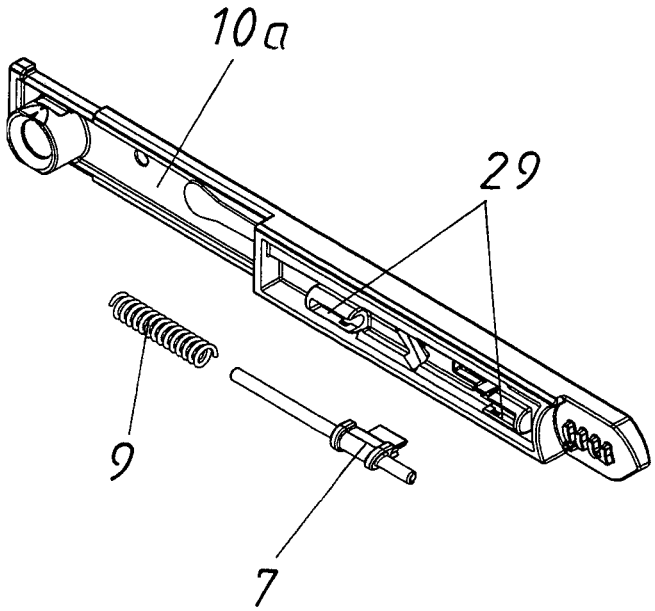

FIGS. 14 and 15 show an exploded view of the ejection device 1 from different sides. As its large components, this ejection device 1 has a housing 10 comprising the mounting portion 10*b*, the housing cover 10*c*, and the displaceable portion 10*a*. The ejection device 1 is connected to the moveable furniture part 2 or to the drawer rail 17 by way of the mounting portion 10*b*. The housing cover 10*c* is fixedly connected to the mounting portion 10*b* by conventional connecting means. The displaceable portion 10*a* is arranged between those two parts, wherein the displacement and thus the depth of the locking position of the entire drawer 2 can be adjusted by the depth adjusting device 14. That rotatable depth adjusting device 14 has at its underside a spiral worm 14*b* corresponding to latching element 14*a* provided on the displaceable portion 10*a*. Provided in the displaceable portion 10*a* is the sliding guide track 3, wherein the latching depression 5 of the sliding guide track 3 is formed by the blocking element 7. The blocking element 7 is mounted displaceably in the guides 29 (see FIGS. 16 and 17) and is subjected to the force of the blocking element spring 9 (compression spring). The slider 11 is mounted slidably or displaceably relative to the entire housing 10. The control lever 12 is mounted pivotably to the slider 11 and at one end has the control pin 4 engaging into the sliding guide track 3. In addition, the ejection element 13 is mounted pivotably at an end of the slider 11. The slider 11 further has synchronization teeth 26 corresponding to a connecting element 23, on which a synchronization bar (not shown) can be arranged for connection to a further ejection device at the other side of the drawer. The ejection device 1 further has an ejection spring 8 held between the spring holder 27 on the housing cover 10*c* and the spring holder 28 on the slider 11.

Figure 18A:
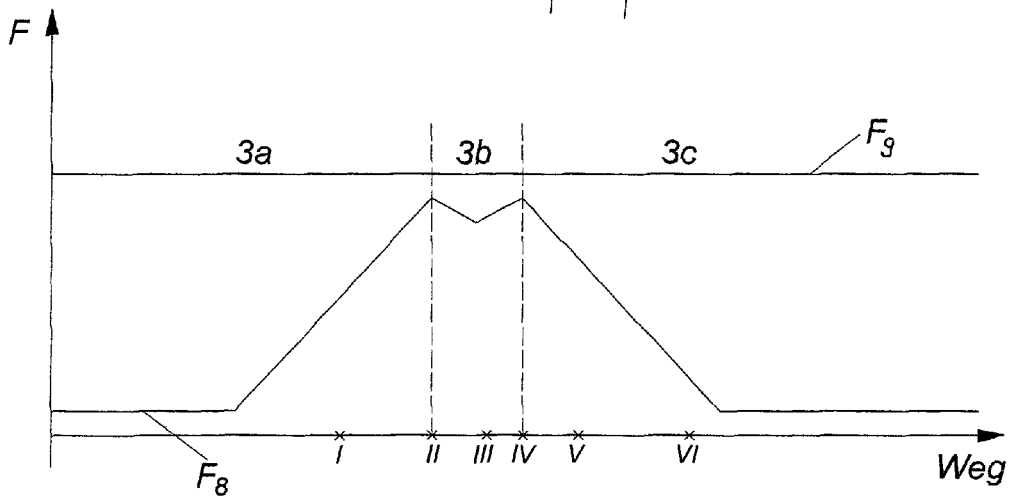

FIG. 18 diagrammatically shows the path of the control pin 4 in the sliding guide track 3. Corresponding thereto, FIG. 18*a* respectively shows the spring force $F_8$ of the ejection spring 8 and the spring force $F_9$ of the spring 9 for the blocking element 7. The entire procedure begins with the movement of the moveable furniture part 2 out of an open position OS in the closing direction SR. In that case the control pin 4 firstly moves into the position I. In that region, the ejection spring 8 and thus its spring force $F_8$ are already stressed. When the position II is reached, that gives the highest spring force $F_8$ of the ejection spring 8. That position II also represents the transition between the opening portion 3*a* and the locking portion 3*b* of the sliding guide track 3. In the locking portion 3*b*, the control pin 4 reaches the position III in which the control pin 4 bears against the latching depression 5 and thus the blocking element 7. That represents the locking position VS and corresponds to the closed position SS of the moveable furniture part 2. When the furniture part is moved out of that closed position SS in the closing direction SR (overpressing), the control pin 4 moves into the position IV representing the transition between the locking portion 3*b* and the opening portion 3*c*. As soon as the control pin 4 then reaches the opening portion 3*c*, the locking position VS is released and the ejection spring 8 can deploy its spring force $F_8$ and eject the moveable furniture part 2. During that ejection process, the control pin 4 reaches the positions V and VI and passes over the branching element 25.

Figure 19:
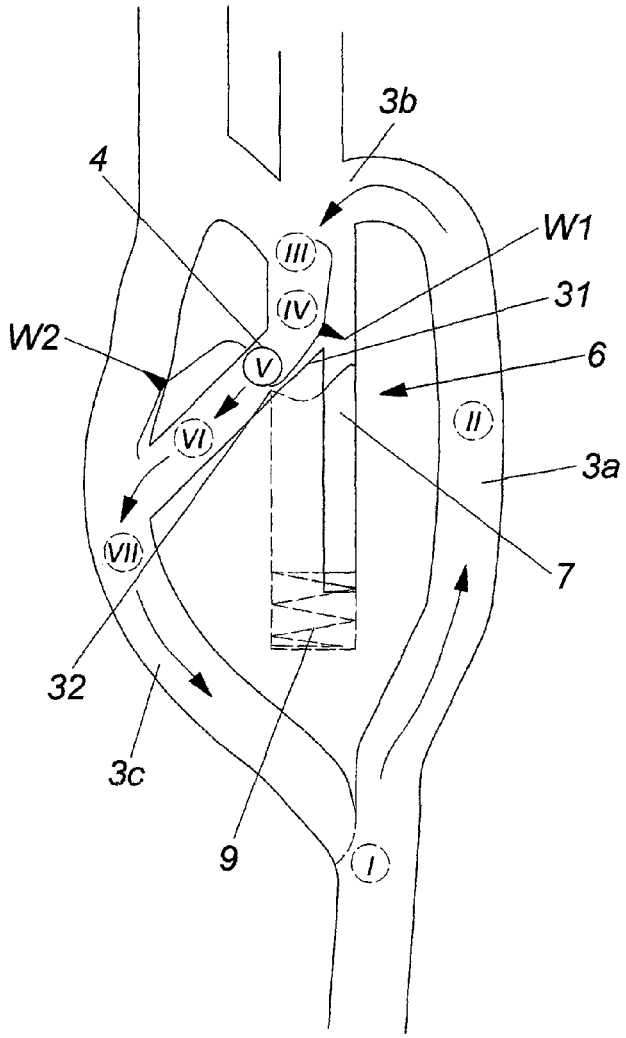
FIG. 19*a* shows the force variation in respect of the springs corresponding to FIG. 19, and FIGS. 20 through 25 show 3D views and details of different positions of the control pin in the sliding guide track.
Figure 19A:
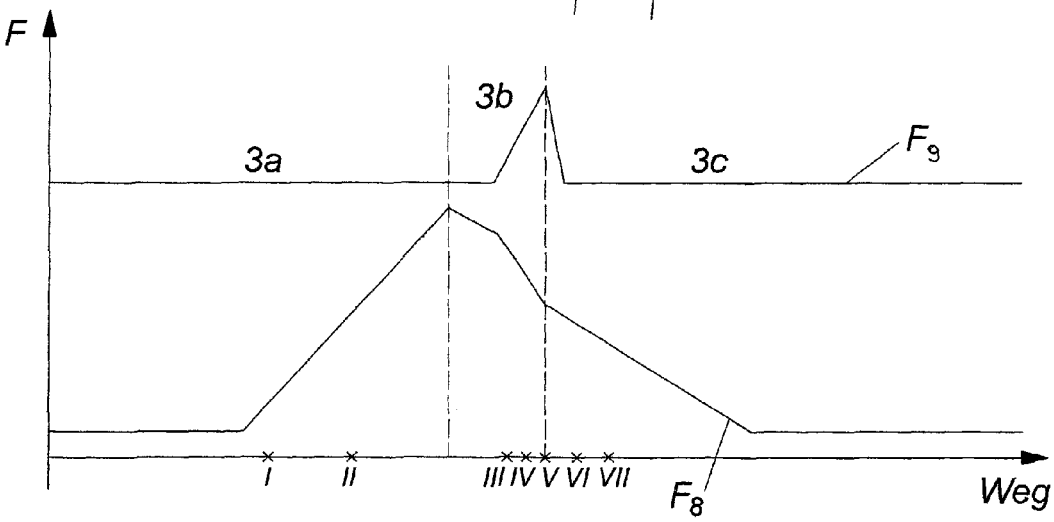

In comparison, FIGS. 19 and 19*a* show the diagrammatic procedure and the positions of the control pin 4 in the sliding guide track 3 or in the overload path W. The overload path W passes through a "cardioid" passage delimited by passage walls. That overload passage is in a fixed spatial association with the portions 3*a*, 3*b* and 3*c*. Once again, at position I, closure of the moveable furniture part 2 begins and thus also begins the movement of the control pin 4 in the opening portion 3*a*, reaching the position II. In that region, the ejection spring 8 and its spring force $F_8$ are stressed. After reaching the locking portion 3*b* the control pin 4 passes into the position III corresponding to the locking position VS. In contrast to FIG. 18, an action is now not applied to the moveable furniture part 2 in the closing direction SR, but a pulling force is applied to the moveable furniture part 2 in the opening direction OR. As a result, the overload mechanism 6 comes into operation, the control pin 4, by moving into position IV, pressing against the blocking element 7 and thereby compressing the spring 9. In that case, the control pin 4 is now disposed in the first part W1 of the overload path (overload passage) W, which can be blocked by the blocking element 7. At the end of the first part of the overload path W1, the control pin 4 is moved towards the left by the inclined deflection portion 31 and moves into position V. In that position V, the spring force $F_9$ of the spring 9 of the blocking element is at its highest. At the same time, the spring force $F_9$ of the ejection spring 8 is also already slightly relieved. It is only when the control pin 4 has entirely pushed the extension 32 of the blocking element 7 in, that the spring force $F_9$ of the spring 9 of the blocking element 7 is overcome and the control pin 4 passes into the second part W2 of the overload path W. In this location, the locking position VS is nullified and the ejection spring 8 begins to act, whereby the control pin 4 reaches the positions VI and VII. It is directly after passing over the left-hand extension 32 that the spring 9 is relieved of stress again and moves the blocking element 7 back into the position shown in FIG. 18 again.

The advantage with this design is that the blocking element 7 forms so-to-speak a bypass line through the heart 30 of the sliding guide track 3. The blocking element 7 blocks that overload path (passage) W and clears it only in the case of an overload situation. In comparison, the portions 3*a*, 3*b* and 3*c* of the sliding guide track remain unchanged and are always in a fixed spatial association with the blockable overload passage W. As a result, even in the event of fast opening and closing movement, there cannot be any jamming of the control pin 4 in the portions 3*a*, 3*b* and 3*c* of the sliding guide track 3, which are in spatially fixed relationship with each other.

Figure 20:
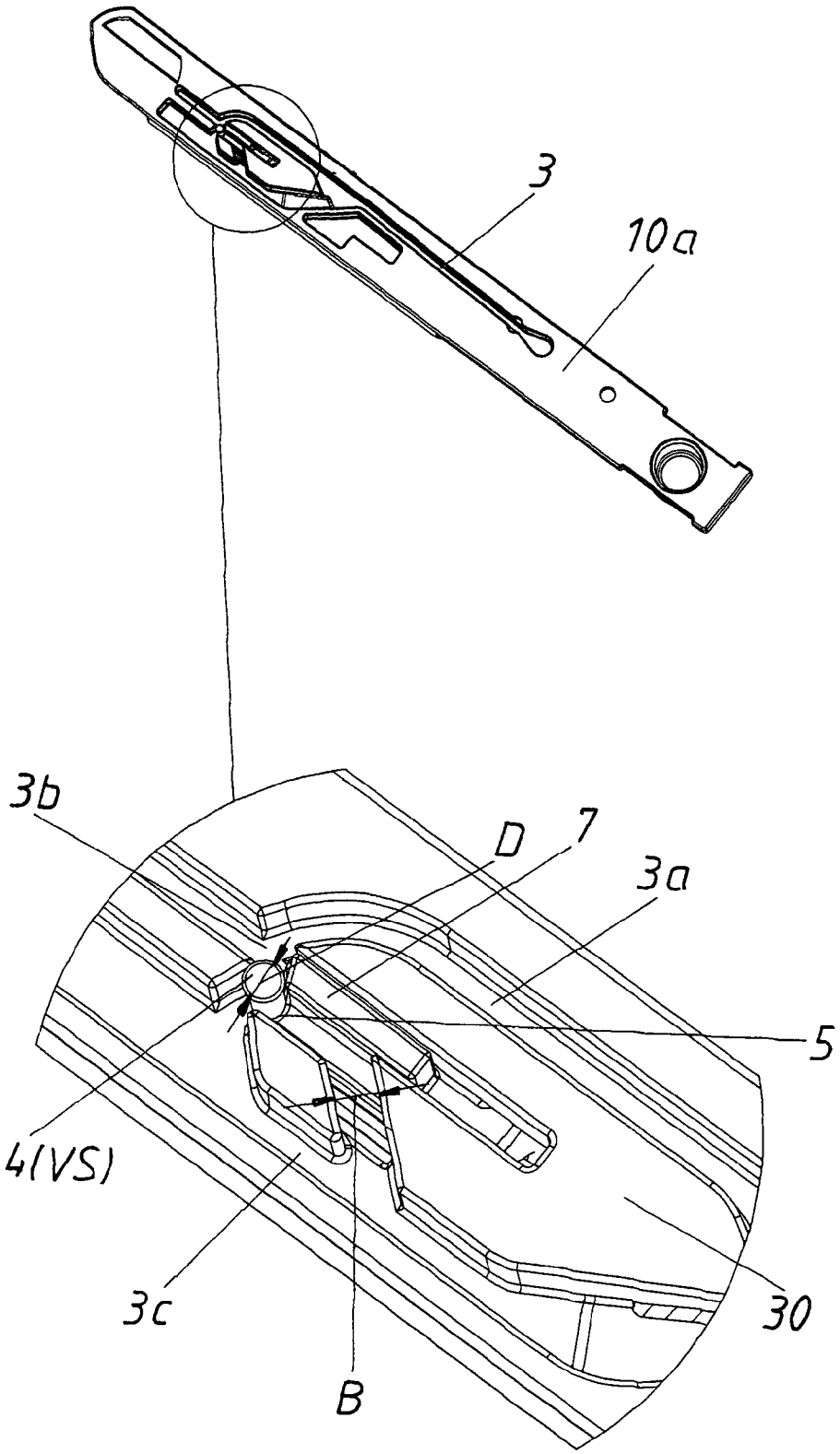

FIG. 20 shows a 3D view of the control pin 4 in the locking position VS, bearing in the latching depression 5 of the blocking element 7. It is preferably provided in that respect that the overload passage through which the overload path W passes has a width B of the passage wall, which remains substantially the same along the overload path W and which is slightly greater than the diameter D of the control pin 4 which is displaceable in the overload path W. In other words, the control pin 4 passes precisely through the overload path W formed by the passage, wherein in the first part W1 it is of a somewhat greater width B.

Figure 21:
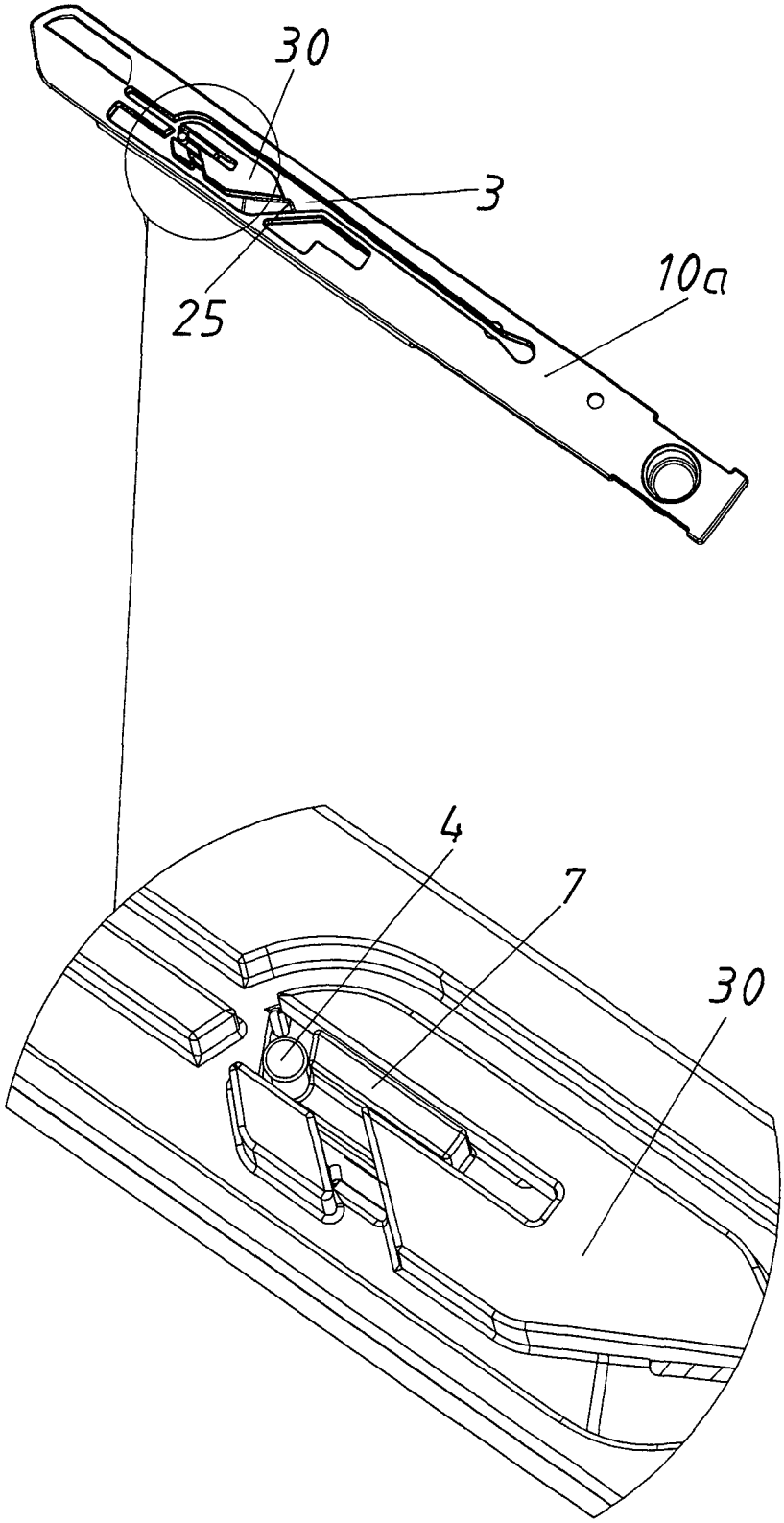
Figure 22:
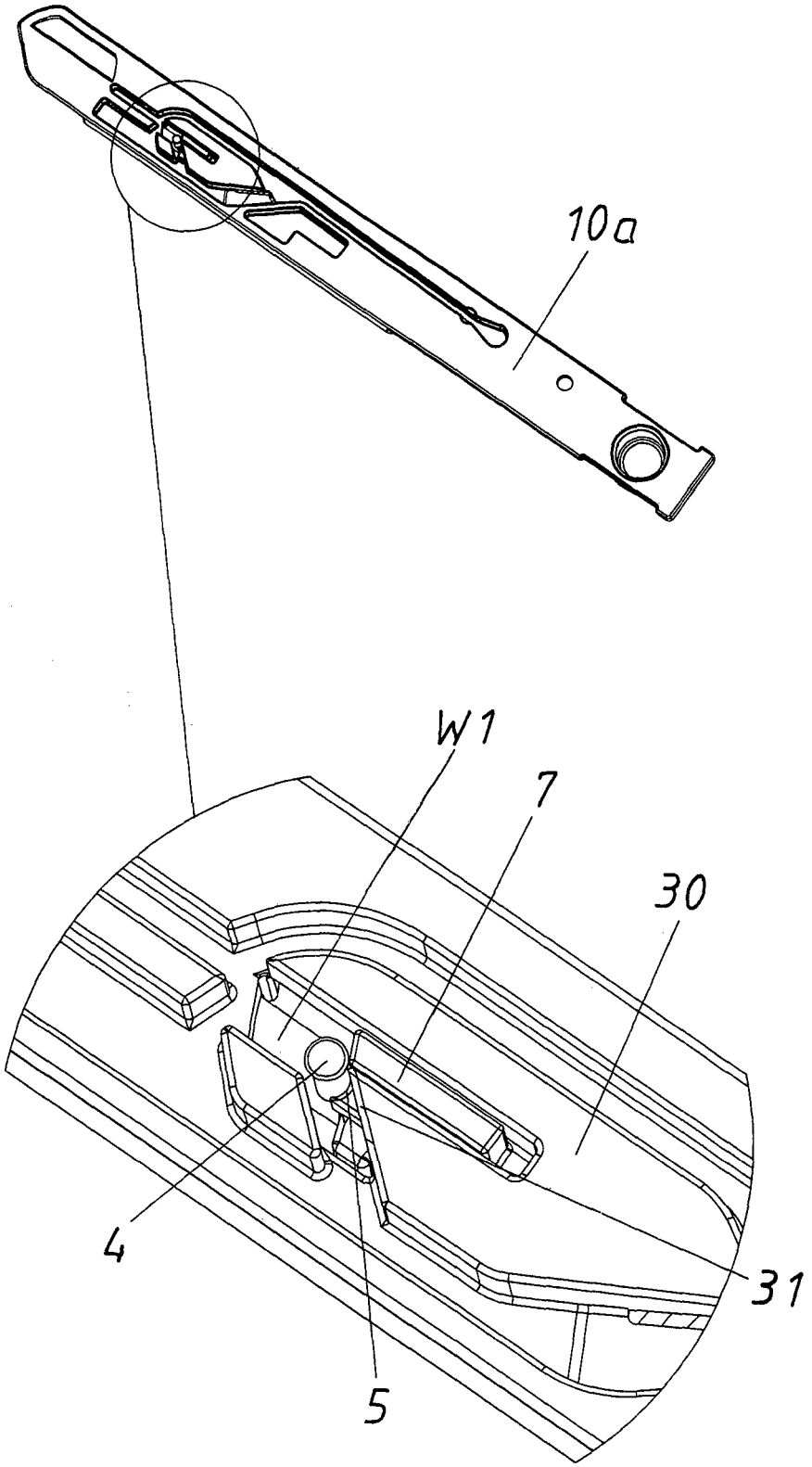
Figure 23:
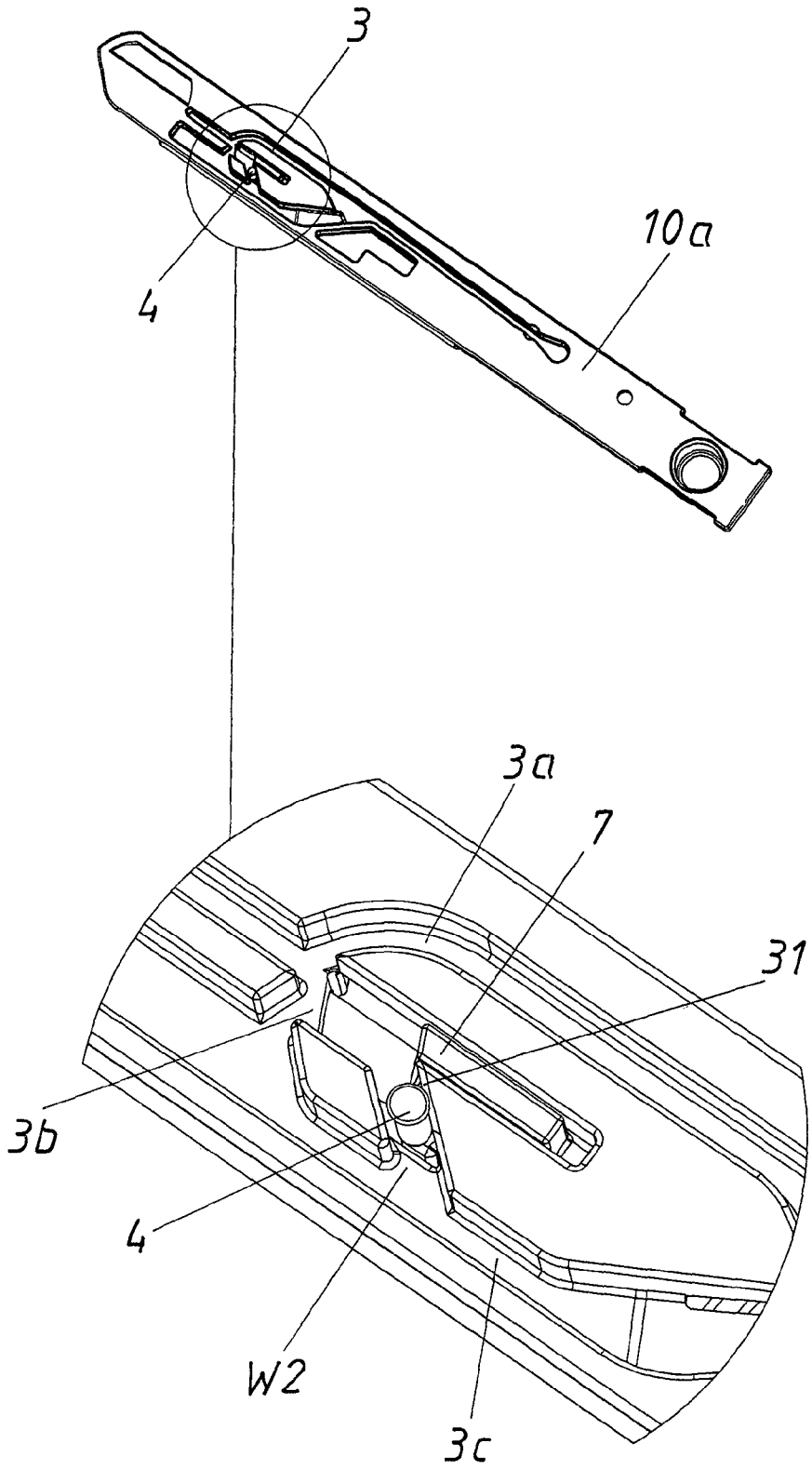
Figure 24:
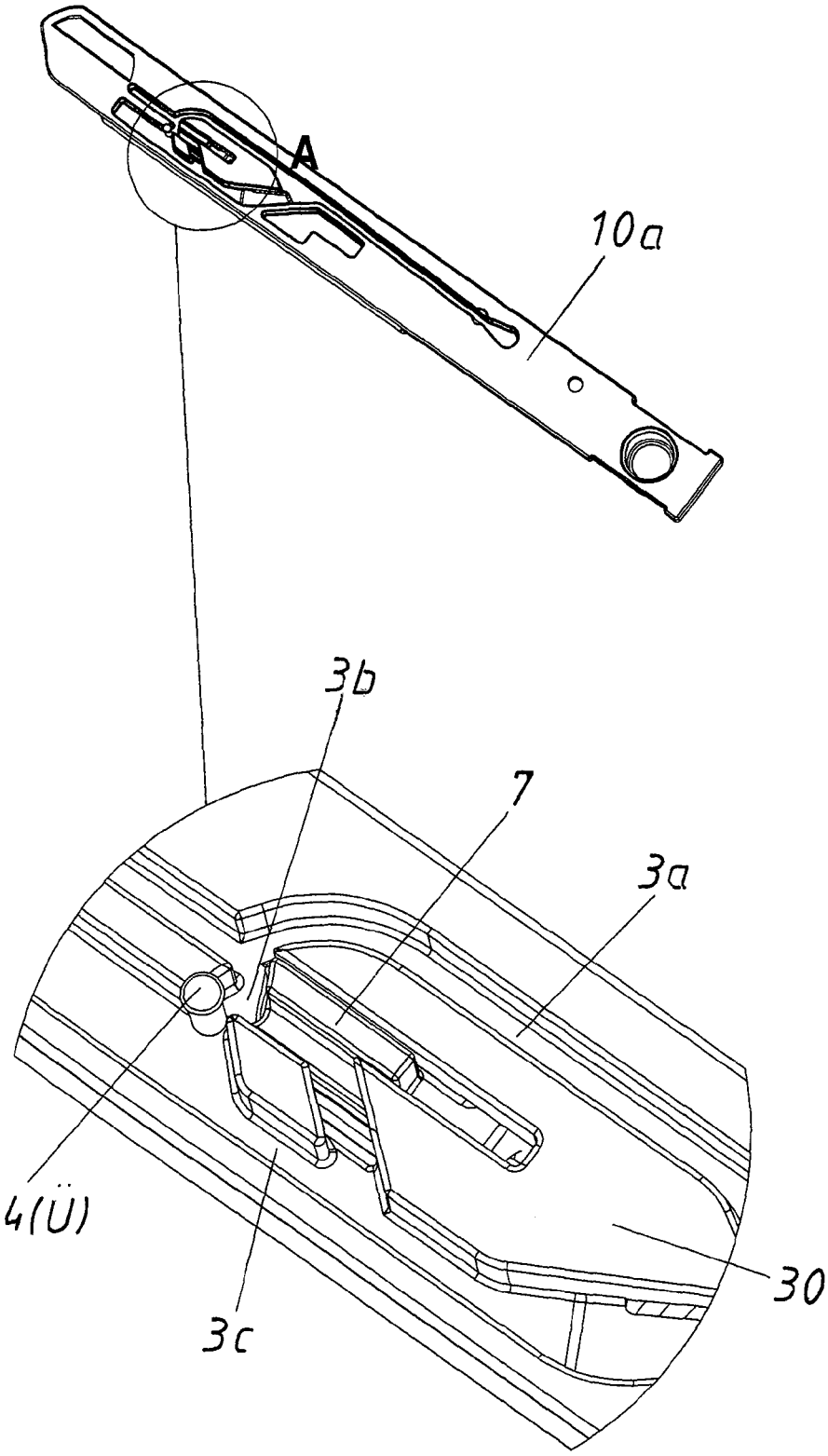
Figure 25:
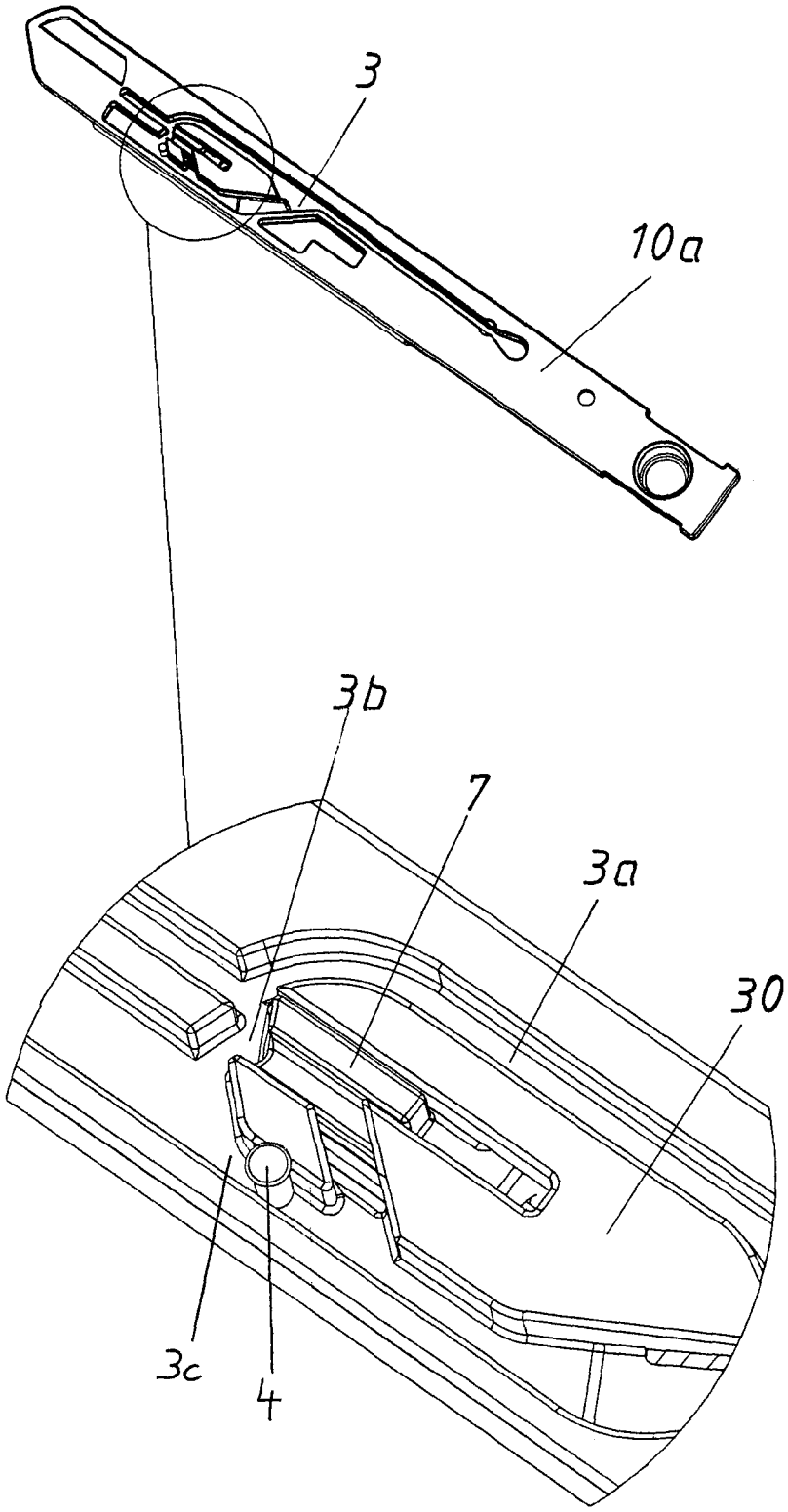

FIGS. 21 through 23 show the overload path W for the control pin 4, those Figures corresponding to FIG. 19. In comparison FIGS. 24 and 25 show the normal path with overpressing of the control pin 4 in the position Ü, which substantially correspond to FIG. 18.

The invention claimed is:

1. A lockable ejection device for ejecting a moveable furniture part, comprising:

a cardioid-shaped sliding guide track;

a control pin moveable in said sliding guide track, said sliding guide track having:

a closing portion in which said control pin is to move during closure of the moveable furniture part;

a locking portion having a latching depression for holding said control pin in a locking position; and an opening portion in which said control pin is to move during opening of the moveable furniture part;

an overload mechanism arranged in said locking portion for releasing said control pin from the locking position upon movement of the moveable furniture part in an opening direction, said overload mechanism including a blocking element subjected to a force and configured to temporarily block said control pin from traveling in an overload passage, said blocking element being configured to at least partially form said latching depression of said locking portion, said overload passage being defined by a passage wall and configured to allow said control pin to pass therethrough during an overload situation and to open into said opening portion, said passage wall being in a fixed spatial relationship with said closing portion and said opening portion, said blocking element being separate from said passage wall and moveable in said overload passage, said blocking element being configured to block a first part of said overload passage in the locking position, and said overload mechanism being configured so that said blocking element is moveable by said control pin during the overload situation in the opening direction against an actuation force of said blocking element and out of a blocking position of blocking the overload passage so that said first part of said overload passage is cleared; and an ejection spring for ejecting the moveable furniture part, said control pin and said overload mechanism being configured such that:

when said first part of said overload passage is cleared, said control pin is moveable into a second part of said overload passage; and when said control pin is in said second part of said overload passage, said ejection device is unlocked and the moveable furniture part is ejectable in the opening direction by said ejection spring.

2. The ejection device as set forth in claim 1, wherein said control pin and said overload mechanism are configured so that said control pin only bears against said blocking element in the locking position.

3. The ejection device as set forth in claim 1, further comprising a blocking spring for applying a spring force to said blocking element.

4. The ejection device as set forth in claim 3, wherein said blocking spring has a spring force greater than a spring force of said ejection spring.

5. The ejection device as set forth in claim 1, wherein said overload passage has a substantially uniform width along a length thereof, and said width being greater than a diameter of said control pin.

6. The ejection device as set forth in claim 1, further comprising:

a housing in which said sliding guide track is located;

a slider displaceable along said housing, said ejection spring having a first end connected to said slider and having a second end connected to said housing;

a control lever pivotably mounted to said slider, said control pin being located on said control lever for engaging into said sliding guide track; and a pivotably mounted ejection element for allowing ejection of the moveable furniture part, said ejection element being arranged on said slider.

7. The ejection device as set forth in claim 6, further comprising a depth adjusting device for displacing a portion of said housing, said sliding guide track being located in said portion of said housing.

8. An article of furniture comprising:

a furniture carcass;

a moveable furniture part moveable with respect to said furniture carcass; and said lockable ejection device of claim 1 configured to eject said moveable furniture part from said furniture carcass.

9. The article of furniture as set forth in claim 8, wherein said moveable furniture part is displaceably mounted to said furniture carcass by an extension rail including:

a drawer rail connected to said furniture part; and a carcass rail connected to said furniture carcass;

wherein said ejection device is arranged at said drawer rail or at said moveable furniture part; and wherein an ejection element is connected to an entrainment member located on said furniture carcass or on said carcass rail in a closed position of said moveable furniture part.

10. The article of furniture as set forth in claim 9, wherein said extension rail further includes a central rail between said drawer rail and said carcass rail, and said ejection element is connected in a positively locking relationship to said entrainment member.

11. The article of furniture as set forth in claim 8, wherein said sliding guide track, said control pin, and said overload mechanism of said ejection device are configured such that said control pin passes out of the locking portion and into said opening portion or into said second part of said overload passage so as to be unlocked either by:

overpressing said moveable furniture part from the closed position into a position behind the closed position; or pulling said moveable furniture part out of the closed position in the opening direction;

wherein said ejection spring is configured to be unloaded when said ejection device is unlocked to ensure that a housing connected to said moveable furniture part is moveable relative to a slider held on an entrainment member fixed with respect to said furniture carcass.

12. A lockable ejection device for ejecting a moveable furniture part, comprising:

a cardioid-shaped sliding guide track;

a control pin moveable in said sliding guide track, said sliding guide track having:

a closing portion in which said control pin is to move during closure of the moveable furniture part;

a locking portion having a latching depression for holding said control pin in a locking position; and an opening portion in which said control pin is to move during opening of the moveable furniture part;

an overload mechanism arranged in said locking portion for releasing said control pin from the locking position upon movement of the moveable furniture part in an opening direction, said overload mechanism including a blocking element subjected to a force and configured to temporarily block said control pin from traveling in an overload passage, said blocking element being configured to at least partially form said latching depression of said locking portion, said overload passage being defined by a passage wall and configured to allow said control pin to pass therethrough during an overload situation and to open into said opening portion, said passage wall being in a fixed spatial relationship with said closing portion and said opening portion, said blocking element being separate from said passage wall and moveable in said overload passage;

an ejection spring for ejecting the moveable furniture part;

a housing in which said sliding guide track is located;

a slider displaceable along said housing, said ejection spring having a first end connected to said slider and having a second end connected to said housing;

a control lever pivotably mounted to said slider, said control pin being located on said control lever for engaging into said sliding guide track; and a pivotably mounted ejection element for allowing ejection of the moveable furniture part, said ejection element being arranged on said slider.

13. The ejection device as set forth in claim 12, wherein said control pin and said overload mechanism are configured so that said control pin only bears against said blocking element in the locking position.

14. The ejection device as set forth in claim 12, further comprising a blocking spring for applying a spring force to said blocking element.

15. The ejection device as set forth in claim 14, wherein said blocking spring has a spring force greater than a spring force of said ejection spring.

16. The ejection device as set forth in claim 12, wherein said overload passage has a substantially uniform width along a length thereof, and said width being greater than a diameter of said control pin.

17. The ejection device as set forth in claim 12, further comprising a depth adjusting device for displacing a portion of said housing, said sliding guide track being located in said portion of said housing.

18. An article of furniture comprising:

a furniture carcass;

a moveable furniture part moveable with respect to said furniture carcass; and said lockable ejection device of claim 12 configured to eject said moveable furniture part from said furniture carcass.

19. The article of furniture as set forth in claim 18, wherein said sliding guide track, said control pin, and said overload mechanism of said ejection device are configured such that said control pin passes out of the locking portion and into said opening portion or into said second part of said overload passage so as to be unlocked either by:

overpressing said moveable furniture part from the closed position into a position behind the closed position; or pulling said moveable furniture part out of the closed position in the opening direction;

said ejection device further comprising an ejection spring for ejecting said moveable furniture part in the opening direction, said ejection spring being configured to be unloaded when said ejection device is unlocked to ensure that a housing connected to said moveable furniture part is moveable relative to a slider held on an entrainment member fixed with respect to said furniture carcass.

20. A lockable ejection device for ejecting a moveable furniture part, comprising:

a cardioid-shaped sliding guide track;

a control pin moveable in said sliding guide track, said sliding guide track having:

a closing portion in which said control pin is to move during closure of the moveable furniture part;

a locking portion having a latching depression for holding said control pin in a locking position; and an opening portion in which said control pin is to move during opening of the moveable furniture part; and an overload mechanism arranged in said locking portion for releasing said control pin from the locking position upon movement of the moveable furniture part in an opening direction, said overload mechanism including a blocking element subjected to a force and configured to temporarily block said control pin from traveling in an overload passage, said blocking element being configured to at least partially form said latching depression of said locking portion, said overload passage being defined by a passage wall and configured to allow said control pin to pass therethrough during an overload situation and to open into said opening portion, said passage wall being in a fixed spatial relationship with said closing portion and said opening portion, said blocking element being separate from said passage wall and moveable in said overload passage;

wherein said control pin and said overload mechanism are configured such that control pin only contacts said blocking element at a portion of said blocking element forming said latching depression without contacting any other portion of said blocking element.

21. A lockable ejection device for ejecting a moveable furniture part, comprising:

a cardioid-shaped sliding guide track;

a control pin moveable in said sliding guide track, said sliding guide track having:

a closing portion in which said control pin is to move during closure of the moveable furniture part;

a locking portion having a latching depression for holding said control pin in a locking position; and an opening portion in which said control pin is to move during opening of the moveable furniture part; and an overload mechanism arranged in said locking portion for releasing said control pin from the locking position upon movement of the moveable furniture part in an opening direction, said overload mechanism including a blocking element subjected to a force and configured to temporarily block said control pin from traveling in an overload passage, said blocking element being configured to at least partially form said latching depression of said locking portion, said overload passage being defined by a passage wall and configured to allow said control pin to pass therethrough during an overload situation and to open into said opening portion, said passage wall being in a fixed spatial relationship with said closing portion and said opening portion, said blocking element being separate from said passage wall and moveable in said overload passage;

wherein said control pin and said overload mechanism are configured such that said blocking element travels with said control pin in a longitudinal direction of a section of said overload passage and through said section of said overload passage during the overload situation.

* * * * *